US009182693B2

(12) United States Patent
Yoshida et al.

(10) Patent No.: US 9,182,693 B2
(45) Date of Patent: Nov. 10, 2015

(54) TONER TO DEVELOP ELECTROSTATIC CHARGE IMAGE, DEVICE TO SUPPLY TONER, AND APPARATUS AND METHOD TO FORM AN IMAGE BY USING TONER

(71) Applicant: Samsung Electronics Co., Ltd., Suwon-si (KR)

(72) Inventors: Takeshi Yoshida, Suwon-si (KR); Sung-jin Park, Suwon-si (KR); Yo-da Shin, Incheon (KR); Hwoing-woon Lee, Yongin-si (KR); Jin-mo Hong, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/788,155

(22) Filed: Mar. 7, 2013

(65) Prior Publication Data

US 2013/0236827 A1 Sep. 12, 2013

(30) Foreign Application Priority Data

Mar. 9, 2012 (KR) ..... 10-2012-0024624

(51) Int. Cl.
*G03G 9/087* (2006.01)
*G03G 9/08* (2006.01)
*G03G 9/093* (2006.01)

(52) U.S. Cl.
CPC ..... *G03G 9/08755* (2013.01); *G03G 9/0804* (2013.01); *G03G 9/0821* (2013.01); *G03G 9/08795* (2013.01); *G03G 9/09328* (2013.01); *G03G 9/09371* (2013.01); *G03G 9/09392* (2013.01)

(58) Field of Classification Search
USPC ..... 430/109.4, 110.2
See application file for complete search history.

(56) References Cited

U.S. PATENT DOCUMENTS

2009/0220879 A1* 9/2009 Matsumoto et al. ..... 430/108.1
2010/0068646 A1* 3/2010 Yamamoto ..... 430/124.1
2010/0151377 A1* 6/2010 Uchino et al. ..... 430/110.2
2011/0183252 A1* 7/2011 Pang et al. ..... 430/109.4

FOREIGN PATENT DOCUMENTS

JP 2004-163805 * 6/2004 ..... G03G 9/087

OTHER PUBLICATIONS

Translation of JP 2004-163805 published Jun. 2004.*

* cited by examiner

*Primary Examiner* — Peter Vajda
(74) *Attorney, Agent, or Firm* — Staas & Halsey LLP

(57) ABSTRACT

A toner to develop an electrostatic charge image, the toner including at least a binder resin, a colorant, and a releasing agent, wherein a weight average molecular weight of the toner measured by using a gel permeation chromatography (GPC) method on a tetrahydrofuran (THF) soluble fraction is in a range of about 30,000 to about 80,000 g/mol, wherein a molecular weight distribution curve of the toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol, a method of preparing the toner, a device to supply the toner, and an apparatus and method of forming an image by using the toner. The toner has more than certain levels of low-temperature fixability, an anti-hot-offset property, a charging ability, a gloss property, and a heat storage ability. The toner has a long lifetime, and thus, provides a high-quality image in a stable and energy-saving manner.

4 Claims, 3 Drawing Sheets

TONER TO DEVELOP ELECTROSTATIC CHARGE IMAGE, DEVICE TO SUPPLY TONER, AND APPARATUS AND METHOD TO FORM AN IMAGE BY USING TONER

CROSS-REFERENCE TO RELATED APPLICATIONS

This application claims priority under 35 U.S.C. §119(a) from Korean Patent Application No. 10-2012-0024624, filed on Mar. 9, 2012, in the Korean Intellectual Property Office, the disclosure of which is incorporated herein in its entirety by reference.

BACKGROUND

1. Field

The present general inventive concept relates to a toner to develop an electrostatic charge image (hereinafter, referred to as "toner") which may be used in an image forming apparatus using an electrophotographic process, such as a copier, a printer, a facsimile, and the like.

2. Description of the Related Art

With advances in electrophotographic fields, an electrophotographic process is used in copiers and printers and for printing applications, and demands for a high-speed, highly reliable, high quality device are on the rise. Accordingly, high gloss properties, durability corresponding to high speed, and long lifetime of a toner have emerged as important factors. In particular, measures to save energy and reduce environmental load have recently become more necessary. One of these measures is to reduce power consumption in a fixing process requiring a large amount of power consumption in the electrophotographic process.

As one of the methods of improving fixability of a toner, a technology to reduce a glass transition temperature or a molecular weight of a binder resin is generally used. When the glass transition temperature of the binder resin is too low, however, blocking of a toner occurs or a storage stability of a fixed image is deteriorated, and thus, it is difficult to obtain a low-temperature fixable toner by using only a method of reducing a glass transition temperature of a binder resin.

In addition, a toner including a crystalline resin is disclosed, as is disclosed in Japanese Patent Application Publication No. hei 1-35454. A crystalline resin has a melting point and is melted at that melting point or a higher temperature, and thus, the addition of the crystalline resin to a binder resin is an effective means to improve fixability of a toner. As a binder resin, a polyester resin is used in terms of improvement in fixability and resin strength. Although a styrene-acrylic resin or an epoxy-based resin may also be used, a polyester resin with high gloss properties may be used to design a resin having desired melting properties. In particular, a crystalline polyester resin having a low melting temperature may be used to obtain low-temperature fixability.

Meanwhile, with recent miniaturization of printers, developers or fixing systems have been miniaturized and stress on a toner has increased. Moreover, under certain use conditions such as a temperature of more than 30° C. (e.g., during summer), a printer main body or a toner itself is exposed to high-temperature conditions, and thus, when 10 or more sheets of paper are continuously printed, time is required to cool the melted toner after a toner including a crystalline polyester resin is fixed. Thus, the fixed image is likely to be nonuniformly formed due to the remaining heat during the fixing process. Accordingly, gloss properties may be deteriorated, or a toner may be excessively heated so that the toner permeates into paper more than is required, resulting in degradation of the image quality. In addition, a toner may be blocked by stress applied inside a developer or an internal temperature of a printer.

SUMMARY OF THE INVENTION

The present general inventive concept provides a toner to develop an electrostatic charge image which has more than certain levels of low-temperature fixability, an anti-hot offset property, a charging property, a gloss property, and a heat storage property.

Additional features and utilities of the present general inventive concept will be set forth in part in the description which follows and, in part, will be obvious from the description, or may be learned by practice of the general inventive concept.

Exemplary embodiments of the present general inventive concept may provide a toner to develop an electrostatic charge image, the toner including at least a binder resin, a colorant, and a releasing agent. A weight average molecular weight of the toner measured by using a gel permeation chromatography (GPC) method on a tetrahydrofuran (THF) soluble fraction is in a range of about 30,000 to about 80,000 g/mol. A molecular weight distribution curve of the toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol.

In the molecular weight distribution curve of the toner obtained by using the GPC method on the THF soluble fraction, a peak area corresponding to a molecular weight of 1,000 g/mol or less may provide about 3% to about 10% of the total area of the molecular weight distribution curve.

The binder resin may include about 80 to about 98 mass % of an amorphous polyester resin and about 2 to about 20 mass % of a crystalline polyester resin.

The toner may have a core-shell structure including a core layer and a shell layer, wherein the core layer includes a binder resin including an amorphous polyester resin and a crystalline polyester resin and the shell layer includes a binder resin only including an amorphous polyester resin.

The releasing agent may be an ester-based wax.

The toner may be prepared using an emulsion-aggregation method using polysilicate iron as an aggregating agent.

When a total iron intensity determined by X-ray fluorescence (XRF) measurement and an iron intensity determined by X-ray photoelectron spectroscopy (XPS) are denoted as [Fe1] and [Fe2], an [Fe2]/[Fe1] ratio of the toner may satisfy the following condition: $0.05 \leq [Fe2]/[Fe1] \leq 0.5$.

Exemplary embodiments of the present general inventive concept may also provide a process cartridge that includes an electrostatic charge image bearing member configured to bear an electrostatic charge image and a developing device configured to develop the electrostatic charge image with a toner that develops an electrostatic charge image. The toner includes at least a binder resin, a colorant, and a releasing agent. A weight average molecular weight of the toner measured by using a gel permeation chromatography (GPC) method on a tetrahydrofuran (THF) soluble fraction is in a range of about 30,000 to about 80,000 g/mol. A molecular weight distribution curve of the toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol to form a toner image.

Exemplary embodiments of the present general inventive concept may also provide a toner device that includes a container to supply a toner that develops an electrostatic charge image. The toner includes at least a binder resin, a colorant, and a releasing agent. A weight average molecular weight of the toner measured by using a gel permeation chromatography (GPC) method on a tetrahydrofuran (THF) soluble fraction is in a range of about 30,000 to about 80,000 g/mol. A molecular weight distribution curve of the toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol.

Exemplary embodiments of the present general inventive concept may also provide an image forming apparatus that includes an electrostatic charge image forming member configured to bear an electrostatic charge image, an electrostatic charge image forming device configured to form an electrostatic charge image on the electrostatic charge image bearing member, a developing device configured to develop the electrostatic charge image with a toner that develops an electrostatic charge image to form a toner image, a transfer device configured to transfer the toner image onto a recording medium, and a fixing device configured to fix the toner image on the recording medium. The toner includes at least a binder resin, a colorant, and a releasing agent. A weight average molecular weight of the toner measured by using a gel permeation chromatography (GPC) method on a tetrahydrofuran (THF) soluble fraction is in a range of about 30,000 to about 80,000 g/mol. A molecular weight distribution curve of the toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol.

Exemplary embodiments of the present general inventive concept may also provide an image forming method including the operations of forming an electrostatic charge image on an electrostatic charge image bearing member, developing the electrostatic charge image with the toner to form a toner image, transferring the toner image onto a recording medium, and fixing the toner image on the recording medium. The toner includes at least a binder resin, a colorant, and a releasing agent. A weight average molecular weight of the toner measured by using a gel permeation chromatography (GPC) method on a tetrahydrofuran (THF) soluble fraction is in a range of about 30,000 to about 80,000 g/mol. A molecular weight distribution curve of the toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Figure 1:
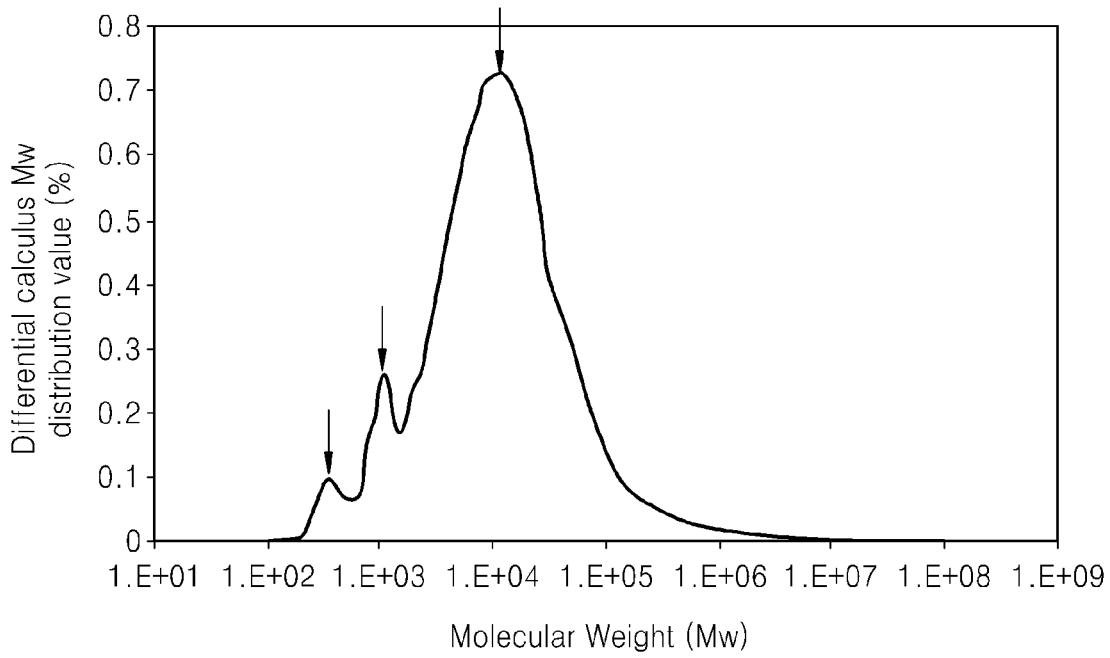
FIG. 1 is a molecular weight distribution curve obtained by using a gel permeation chromatography (GPC) method on a tetrahydrofuran (THF) soluble fraction, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. As used herein, the term "and/or" includes any and all combinations of one or more of the associated listed items. Expressions such as "at least one of," when preceding a list of elements, modify the entire list of elements and do not modify the individual elements of the list.

Hereinafter, exemplary embodiments of a toner to develop an electrostatic charge image and a method of preparing the toner will be described in detail.

According to an embodiment of the present general inventive concept, a toner to develop an electrostatic charge image includes at least a binder resin, a colorant, and a releasing agent.

The binder resin may include about 80 to about 98 mass % of an amorphous polyester resin and about 2 to about 20 mass % of a crystalline polyester resin.

The toner may have a core-shell structure including a core layer and a shell layer, wherein the core layer includes a binder resin including an amorphous polyester resin and a crystalline polyester resin and the shell layer includes a binder resin only including an amorphous polyester resin. If the crystalline polyester resin included in the core layer is exposed on surfaces of toner particles, heat storage ability and electrical properties of the toner may be deteriorated.

A weight average molecular weight of the toner measured by using a gel permeation chromatography (GPC) method on a tetrahydrofuran (THF) soluble fraction is in a range of about 30,000 to 80,000 g/mol, for example, in a range of about 35,000 to about 60,000 g/mol. When the weight average molecular weight of the toner is within these ranges, a balance between properties and ease of preparation of the toner may be obtained. For example, when the weight average molecular weight of the toner is less than 30,000 g/mol, the strength and durability of the toner may be reduced. On the other hand, when the weight average molecular weight of the toner is greater than 80,000 g/mol, an excess amount of energy may be consumed when fixing a toner image.

A molecular weight distribution curve of the toner measured by using a GPC method on a THF soluble fraction has at least one peak in a molecular weight range of 100 to 1,000 g/mol, a peak in a molecular weight range of 1,000 to 5,000 g/mol, for example, 1,000 to 3,000 g/mol, and a main peak in a molecular weight range of 5,000 to 20,000 g/mol, for example, 7,000 to 16,000 g/mol, for example, 8,000 to 14,000 g/mol, and for example, 8,500 to 13,500 g/mol.

As the amounts of a low molecular weight binder resin, in particular, a low molecular weight amorphous polyester resin, and a releasing agent increase, the peak area in a molecular weight range of 100 to 1,000 g/mol increases. The low molecular weight amorphous polyester resin corresponding to the peak area in a molecular weight range of 100 to 1,000 g/mol increases a compatibility between the crystalline polyester resin and the amorphous polyester resin that constitute the binder resin, and thus, a melting initiation temperature of the toner during fixing may be optimized in terms of achievement of balance with heat storage ability of the toner. Therefore, the toner may have more than certain levels of low-temperature fixability and heat storage ability. An amorphous polyester resin and a crystalline polyester resin, which may be used as a binder resin of the toner, have a difference between solubility parameter (SP) values (Generally, a SP value of the crystalline polyester resin may be about 20% smaller than a SP value of a conventional amorphous polyester resin that may be used in a toner), and thus, a compatibility therebetween is very poor. However, since the amorphous polyester resin includes such a characteristically low molecular weight amorphous polyester resin, the amorphous polyester resin may have a partial compatibility with the crystalline polyester resin. A mechanism that shows a good compatibility between the crystalline polyester resin and the amorphous polyester resin has not yet been confirmed. Although the crystalline and amorphous polyester resins have a difference in SP values, both the amorphous and crystalline polyester resin are similar in that both are a polymer having ester bonds which link repeating units, and thus, a somewhat partial compatibility between the amorphous and crystalline polyester resins is formed when they have a low molecular weight, thus preventing the formation of a domain structure such as a sea-island phase separation structure. Therefore, problems, which may arise when a crystalline polyester resin is used as a binder resin, include that although a fixability of a toner may be improved, when time is required to solidify a toner image after a fixing process, crystallization of the crystalline polyester resin progresses so slowly that crystal growth occurs, causing an uneven surface of the fixed image and decreasing a degree of gloss of an image.

As described above, when the amount of the releasing agent increases, the peak area in a molecular weight range of 100 to 1,000 g/mol increases. When an ester-based wax is used as a releasing agent, compatibility between the crystalline polyester resin and the releasing agent is increased, thus improving a melting behavior of the toner. Accordingly, low-temperature fixability, image durability, and abrasion resistance of the toner may be increased.

The peak in a molecular weight range of 1,000 to 5,000 g/mol corresponds to a complex formed by ionic crosslinking between iron ions ($Fe^{2+}$, $Fe^{3+}$) derived from an aggregating agent, which will be described below, and carboxylic groups of a polyester resin. This peak indicates an aggregated state of toner particles and contributes to the strength of toner particles. That is, if the peak area is small, the aggregation strength of toner particles is weak, and thus, the strength of the toner particles becomes weak, resulting in poor durability of the toner. On the other hand, if the peak area is large, the aggregation strength of toner particles is so strong that the durability of the toner increases, while low-temperature fixability of the toner is deteriorated.

The peak in a molecular weight range of 5,000 to 20,000 g/mol is an indicator of the amounts of a high molecular weight crystalline polyester resin and a high molecular weight amorphous polyester resin. The high molecular weight crystalline polyester resin and the high molecular weight amorphous polyester resin maintain the strength of a surface of a fixed image.

In the molecular weight distribution curve of the toner obtained by using a GPC method on a THF soluble fraction, a peak area corresponding to a molecular weight of 1,000 g/mol or less may provide about 3% to about 10%, for example, about 4% to about 8%, for example, about 5% to about 7.5% of the total area of the molecular weight distribution curve. When the peak area corresponding to a molecular weight of 1,000 g/mol or less is less than about 3%, a melting initiation temperature of the toner does not decrease, and thus, the toner has poor low-temperature fixability. When the peak area corresponding to a molecular weight of 1,000 g/mol or less is greater than about 10%, the melting initiation temperature of the toner is too low, and thus, the toner permeates into paper during a fixing process, and thus, an image has an uneven surface, resulting in a decreased degree of gloss of the toner.

As described above, the toner may have more than certain levels of fixability, gloss, heat storage ability, and charging ability by precisely controlling the molecular weight distribution and the releasing agent of the toner.

FIG. 1 is a molecular weight distribution curve measured by using a GPC method on a THF soluble fraction, according to an embodiment of the present general inventive concept.

Hereinafter, constituents of a toner to develop an electrostatic charge image according to an embodiment of the present general inventive concept will be described below in detail.

The toner includes a binder resin, a colorant, and a releasing agent, wherein the binder resin includes an amorphous polyester resin and a crystalline polyester resin.

(Amorphous Polyester Resin)

The amorphous polyester resin used in the toner refers to a polyester resin not having an endothermic peak corresponding to a crystalline melting temperature, but having a stepwise endothermic change (i.e., the so-called baseline shift in a DSC thermograms) corresponding to glass transition in differential scanning calorimetry (DSC). The amorphous polyester resin may be a known amorphous polyester resin. The amorphous polyester resin may be synthesized by using polycarboxylic acid and polyhydric alcohol. A commercially available amorphous polyester resin or a synthesized amorphous polyester resin may be used. In addition, the amorphous polyester resin may be one kind of amorphous polyester resin or a mixture of two kinds of amorphous polyester resins.

To obtain desired properties of the toner, a high molecular weight amorphous polyester resin (A) having a high acid value and a low molecular weight amorphous polyester resin (B) having a low acid value are mixed with a crystalline polyester resin, thus obtaining a peak shape of the characteristic molecular weight distribution curve described above.

The polyester resin may be generally obtained by a polycondensation reaction of at least one diol and at least one dicarboxylic acid. In addition, several kinds of polyester resins may be used in combination to adjust a molecular weight distribution, a glass transition temperature (Tg), or the like. The polycondensation reaction may be generally performed at a temperature ranging from 150° C. to 300° C., for example, 180° C. to 270° C., for example, 180° C. to 250° C. When the polycondensation reaction temperature is less than 150° C., a reaction time is extended. On the other hand, when the polycondensation reaction temperature is greater than 300° C., monomers and resins may be degraded.

Examples of a diol used as a raw material of the polyester resin include ethylene glycol, 1,2-propanediol, 1,3-propanediol, 1,3-butanediol, 1,4-butanediol, 2,3-butanediol, diethylene glycol, triethylene glycol, dipropylene glycol, 1,5-pentane diol, 1,6-hexane diol, neopentyl glycol, 2-ethyl-1,3-hexane diol, hydrogen-added bisphenol A, an ethylene oxide adduct of bisphenol A, a propylene oxide adduct of bisphenol A, and the like. In particular, the diol may be an ethylene oxide adduct of bisphenol A, a propylene oxide adduct of bisphenol A, diethylene glycol, triethylene glycol, ethylene glycol, or neopentyl glycol. More particularly, the diol may be a propylene oxide adduct of bisphenol A, an ethylene oxide adduct of bisphenol A, ethylene glycol, or a neopentyl glycol.

Examples of dicarboxylic acid used as a raw material of the polyester resin include an aliphatic saturated dicarboxylic acid such as malonic acid, succinic acid, glutaric acid, adipic acid, azelaic acid, and sebacic acid; an aliphatic unsaturated dicarboxylic acid such as maleic acid, fumaric acid, citraconic acid, and itaconic acid; an aromatic dicarboxylic acid such as phthalic acid, terephthalic acid, and isophthalic acid; an anhydride of the dicarboxylic acid (e.g., anhydrous succinic acid, anhydrous maleic acid, anhydrous phthalic acid, and the like); a $C_1$-$C_6$ lower alkyl ester (e.g., dimethyl succinate, diethyl maleate, dihexyl phthalate, and the like); and a dicarboxylic acid having a long-chain alkyl side chain (e.g., an alkyl side chain having at least 4 carbon atoms) such as 1,2-hexane diol, an alkyl succinic acid, an alkenyl succinic acid, and anhydrides thereof, which are used to improve compatibility with a crystalline resin. In particular, the dicarboxylic acid may be adipic acid, terephthalic acid, isophthalic acid, or an alkenyl succinic acid. More particularly, the dicarboxylic acid may be terephthalic acid, isophthalic acid, or an alkenyl succinic acid.

In addition, if desired, a raw material of the polyester resin may be selected from polyhydric alcohol having trivalency or more such as glycerin, 2-methylpropane triol, trimethylol propane, trimethylol ethane, sorbitol, sorbitan, and the like; an aliphatic monocarboxylic acid such as octanoic acid, decanoic acid, dodecanoic acid, myristic acid, palmitic acid, stearic acid, and the like; an aliphatic monocarboxylic acid having a branched group or a unsaturated group; an aliphatic monoalcohol such as octanol, decanol, dodecanol, myristyl alcohol, palmityl alcohol, stearyl alcohol, and the like; an aromatic monocarboxylic acid such as benzoic acid, naphthalene carboxylic acid, rosin acid, and the like; a polycarboxylic acid having trivalency or more such as trimellitic acid, pyromellitic acid, and the like; and anhydrides thereof. By using these compounds, a molecular weight or Tg of the polyester resin may be adjusted or the polyester resin may have a branched structure. In particular, glycerin, trimethylol propane, stearic acid, trimellitic acid, or benzoic acid may be used, and more particularly, trimethylol propane, stearic acid, or trimellitic acid may be used.

The alkyl succinic acid, the alkenyl succinic acid, and the anhydrides thereof may be, for example, n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, isododecenyl succinic acid, or anhydrides thereof; or lower alkyl esters thereof.

The number of carbon atoms of an alkyl group and an alkenyl group of the alkyl succinic acid, the alkenyl succinic acid, and the anhydrides thereof may be greater than the number of carbon atoms of a constituent monomer of an aliphatic crystalline polyester resin, which will be described below, to satisfy desired properties of the binder resin described above. In addition, among the materials described above, n-dodecenyl succinic acid or the anhydride thereof may be used because such materials have good compatibility with an aliphatic crystalline polyester resin, and a glass transition temperature of the amorphous polyester resin may be adjusted without problems.

A catalyst that may be used in a polycondensation reaction and/or a depolymerization reaction performed to obtain the amorphous polyester resin may be a catalyst including an element selected from titanium, germanium, aluminum, and zirconium. In particular, the catalyst may be a catalyst including titanium and/or germanium. A tin-based catalyst such as dibutyl tin oxide or an antimony-based catalyst such as antimony trioxide is not desirable in terms of safety to environments and living organisms. A Ti-containing catalyst may be a titanium chelate, a titanium acylate, a titanium alkoxide, or the like. In particular, the Ti-containing catalyst may be titanium lactate, titanium ethylacetoacetate, tetra-n-butyl titanate, or tetra(2-ethylhexyl)titanate. A Ge-containing catalyst may be germanium dioxide. The amount of the catalyst added may be in the range of 0.01 mass % to 1 mass % based on the total amount of raw materials added for the reaction for forming the amorphous polyester resin. The catalyst may be used alone or in combination of at least two kinds of catalysts. The catalyst may be added when the polymerization reaction is initiated or in the middle of the polymerization reaction.

In particular, examples of the Ti-containing catalyst include, but are not limited to, titanium alkoxides under the trade names of Orgatics TA-25 (tetra-n-butyl titanate), TA-30 (tetra(2-ethyl hexyl)titanate), TA-70 (tetramethyl titanate), and the like, titanium acylates under the trade name of Orgatics TPHS (polyhydroxy titanium stearate), and titanium chelates under the trade names of Orgatics TC-401 (titanium tetraacetylacetonate), TC-200 (titanium octyleneglycolate), TC-750 (titanium ethylacetoacetate), TC-310 (titanium lactate), and TC-400 (titanium triethanolaminate), which are all manufactured by MATSUMOTO PHARMACEUTICAL MANUFACTURE CO., LTD.).

At least one amorphous polyester resin according to an embodiment of the present general inventive concept may have a weight average molecular weight (Mw) of equal to or greater than about 30,000 g/mol and equal to or less than about 50,000 g/mol in molecular weight measurement by using a GPC method on a THF soluble fraction and have at least one peak in a weight average molecular weight (Mw) range of 100 g/mol to 1,000 g/mol in a molecular weight distribution curve. In addition, an area of a portion corresponding to an Mw of 1,000 g/mol or less may be equal to or greater than about 3% and equal to or less than about 10%, for example, equal to or greater than about 4% and equal to or less than about 6%, with respect to the total area of the molecular weight distribution curve. When the area of the portion corresponding to an Mw of 1,000 g/mol or less is less than about 3%, a partial compatibility of the amorphous polyester resin with the crystalline polyester resin deteriorates, and thus, a melting-starting temperature of the toner during fixing barely varies and it is difficult to obtain desired low-temperature fixability of the toner. On the other hand, when the area of the portion corresponding to an Mw of 1,000 g/mol or less is greater than about 10%, the compatibility therebetween is excessively high, and thus, the melting initiation of the entire toner is shifted towards low temperatures so that heat storage ability of the toner is decreased.

At least one amorphous polyester resin according to an embodiment of the present general inventive concept may have a main peak in a weight average molecular weight range (Mw) of 5,000 to 20,000 g/mol, for example, 8,000 to 16,000 g/mol. When the Mw of the amorphous polyester resin is less than 5,000 g/mol, the area of the portion corresponding to an Mw of 1,000 g/mol or less is greater than about 10% of the total area of the molecular weight distribution curve. On the other hand, when the Mw of the amorphous polyester resin is greater than 20,000 g/mol, the area of the portion corresponding to an Mw of 1,000 g/mol or less is less than about 3% of the total area of the molecular weight distribution curve, and thus, low-temperature fixability of the toner may be poor. The expression "having a peak in a certain molecular weight range" used herein means that as indicated by an arrow in FIG. 1, a molecular weight corresponding to each peak in a molecular weight distribution curve falls on the certain molecular weight range. The main peak refers to a peak having the largest area in a molecular weight distribution curve.

The molecular weight and the molecular weight distribution are measured by GPC. The molecular weight distribution is measured as follows. A Waters 2695, Waters 2414 RI detector (manufactured by WATERS CORPORATION) is used as a GPC apparatus, three columns (Model: Styragel HR2, HR4, and HR5 (7.8 mm×300 mm)) are used, and THF is used as a carrier solvent. The experiment conditions are as follows: a sample concentration of 1.0%, flow rate of 1.0 ml/min, a sample injection amount of 10 μL, and a measurement temperature of 35° C., and a calibration curve is prepared from Shoex Standard SM-105.

At least one amorphous polyester resin according to an embodiment of the present general inventive concept may have a glass transition temperature (Tg) ranging from 50° C. to 70° C., for example, 55° C. to 65° C. When the Tg of the amorphous polyester resin is less than 50° C., storage stability of the toner may be deteriorated or blocking (i.e., a phenomenon in which toner particles aggregate with each other to form larger clusters) of the toner inside a developer is likely to occur. On the other hand, when the Tg of the amorphous polyester resin is greater than 65° C., the toner may not have sufficient low-temperature fixability as compared to a conventional toner.

A Tg of the amorphous polyester resin (A) is obtained by interpreting an endothermic curve during a second heating process which is obtained using a differential scanning calorimetry (DSC Q2000 manufactured by TA Instrument) by raising a temperature from room temperature to 150° C. at a heating rate of 10° C./min, being held at 150° C. for 1 minute, cooling from 150° C. to 0° C. at a cooling rate of 10° C./min by using a liquid nitrogen, being held at 0° C. for 1 minute, and raising a temperature from 0° C. to 150° C. at a heating rate of 10° C./min. In this regard, an intersection point obtained by extending a straight line portion before the phase transition and a straight line portion in the middle of the phase transition is determined as a glass transition temperature.

At least one of the amorphous polyester resins may have an acid value in a range of about 5 mg KOH/g to about 20 mg KOH/g, for example, about 10 mg KOH/g to about 15 mg KOH/g, in terms of formation of ionic crosslinking of a carboxylic group of the polyester resin. The acid value is measured by neutralization titration as follows. 5 g of a sample is dissolved in 50 ml of a mixed solvent of xylene/dimethylformamide (mass ratio of 1:1), several droplets of a phenolphthalein/ethanol solution as an indicator are added thereto, and then the resultant solution is titrated using a 0.1N KOH aqueous solution. A point at which a color of the sample solution turns from colorlessness to purple is denoted as an end point, and an acid value (KOH mg/g) is calculated from a titer and the mass of the sample at the end point.

The amount of at least one of the amorphous polyester resins of the binder resin is not particularly limited, and may be in the range of about 80 mass % to about 98 mass %, for example, about 86 mass % to about 98 mass %. When the amount of at least one of the amorphous polyester resins of the binder resin is less than about 80 mass %, the strength of the toner is likely to deteriorate. On the other hand, when the amount of at least one of the amorphous polyester resins of the binder resin is greater than about 98 mass %, low-temperature fixability of the toner may not be obtained.

(Crystalline Polyester Resin)

A crystalline polyester resin is a binder resin of a toner and is used to improve a degree of gloss of an image, stability, and low-temperature fixability. A crystalline polyester resin according to an embodiment of the present general inventive concept is synthesized from a divalent acid (dicarboxylic acid) component and a divalent alcohol (diol) component. The term "crystalline polyester resin" used herein indicates a resin having a clear endothermic peak in the differential scanning calorimetry (DSC) and not exhibiting a stepwise endothermic change. In the case of a polymer where another component is polymerized to the main chain of the crystalline polyester resin, when the content of another component is 50 mass % or less, this copolymer is also called a crystalline polyester resin.

The dicarboxylic acid may be used alone or in combination of two kinds of dicarboxylic acids. The dicarboxylic acid may be an aliphatic dicarboxylic acid, in particular, a linear aliphatic dicarboxylic acid. Examples of the linear aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,18-octadecanedicarboxylic acid, 1,20-eicosanedicarboxylic acid, and lower alkyl esters or anhydrides thereof. Among these, a linear aliphatic dicarboxylic acid having 6 to 10 carbon atoms may be used in terms of a crystalline melting point and charging ability. To increase crystallinity, such a linear aliphatic dicarboxylic acid may be used in an amount of 95 mol % or more, for example, 98 mol % or more, based on the total amount of constituent components of the dicarboxylic acid.

The diol may be used alone or in combination of two kinds of diols. The diol may be an aliphatic diol. Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among these, a linear aliphatic diol having 2 to 10 carbon atoms may be used in terms of a crystalline melting point or charging ability. To raise the crystallinity, such a linear aliphatic diol may be used in an amount of 95 mol % or more, for example, 98 mol % or more, based on the total amount of constituent components of the diol.

The crystalline polyester resin may be synthesized as explained above for the amorphous polyester resin. As for the catalyst, the titanium-containing catalyst may be mainly used and may be used in combination with other catalysts. As the other catalysts, catalysts that may be used in the polycondensation reaction for forming the amorphous polyester resin may also be used.

A melting point of the crystalline polyester resin may be in the range of 50° C. to 120° C., for example, 60° C. to 110° C. When the melting point of the crystalline polyester resin is less than 50° C., storage properties of the toner or storage properties of a toner image after fixing may be adversely affected. On the other hand, when the melting point of the crystalline polyester resin is greater than 120° C., sufficient low-temperature fixability may not be obtained as compared to a conventional toner.

The melting point of the crystalline polyester resin may be measured under the same conditions as described above in the method of measuring a glass transition temperature of the amorphous polyester resin. In this regard, an intersection point obtained by extending a straight line portion before the phase transition and a straight line portion in the middle of the phase transition is determined as a melting point. The differential thermal analysis to determine the melting point is performed by differential scanning calorimetry in accordance with ASTM D3418-8.

With respect to the molecular weight of the crystalline polyester resin, in the molecular weight measurement by using a GPC method on a THF soluble fraction, a weight average molecular weight (Mw) of the crystalline polyester resin may be in the range of about 4,000 to about 40,000 g/mol, for example, about 5,000 to about 30,000 g/mol, and a number average molecular weight (Mn) of the crystalline polyester resin may be in the range of about 3,000 to about 20,000 g/mol, for example, about 4,000 to about 12,000 g/mol. The molecular weight distribution index, i.e., polydispersity index, Mw/Mn may be from about 1 to about 10, for example, from about 1 to about 5. When the weight average molecular weight (Mw) and the number average molecular weight (Mn) are less than the ranges described above, the toner may be effective in low-temperature fixability, but a storage property of the toner, such as blocking of the toner, may be adversely affected. On the other hand, when the weight average molecular weight (Mw) and the number average molecular weight (Mn) are greater than the ranges described above, seepage of the toner is insufficient, and thus, conservative properties of documents may be adversely affected.

The crystalline polyester resin may have an acid value of about 4 to about 30 mg KOH/g, for example, about 7 to about 20 mg KOH/g. The crystalline polyester resin may have a hydroxyl value of about 3 to about 15 mg KOH/g, for example, about 5 to about 10 mg KOH/g.

The amount of the crystalline polyester resin in the binder resin may be in the range of about 2 to about 20 mass %, for example, about 2 to about 14 mass %. When the amount of the crystalline polyester resin is greater than about 20 mass %, the domain size of the crystalline polyester resin increases, and thus exposing of the crystalline polyester resin to the surface of the toner is facilitated, causing a reduction in fluidity of the toner or reduction of a charging ability of the toner. On the other hand, when the amount of the crystalline polyester resin is less than about 2 mass %, low-temperature fixability of the toner may be adversely affected.

(Colorant)

Examples of a yellow pigment as a colorant that may be used in a toner according to an embodiment of the present general inventive concept include Lead Yellow, Zinc Yellow, Yellow Iron Oxide, Cadmium Yellow, Chrome Yellow, Hansa Yellow, Hansa Yellow 10G, Benzidine Yellow G, Benzidine Yellow GR, Threne Yellow, Quinoline Yellow, and Permanent Yellow NCG. In particular, the yellow pigment may be C.I. Pigment Yellow 17, C.I. Pigment Yellow 74, C.I. Pigment Yellow 97, C.I. Pigment Yellow 155, C.I. Pigment Yellow 180, C.I. Pigment Yellow 185, and the like.

Examples of a magenta pigment as a colorant that may be used in a toner according to an embodiment of the present general inventive concept include Bengala, Cadmium Red, Red Lead, mercury sulfide, Permanent Red 4R, Lithol Red, Brilliant Carmine 3B, Brilliant Carmine 6B, DuPont Oil Red, Pyrazolone Red, Rhodamine Lake B, Lake Red C, Rose Bengal, Eosin Red, Alizarin Lake, a naphthol-based pigment such as Pigment Red 31, Pigment Red 146, Pigment Red 147, Pigment Red 150, Pigment Red 176, Pigment Red 238, and Pigment Red 269, a quinacridone-based pigment such as Pigment Red 122, and Pigment Red 202, Pigment Red 209, and the like. Among these magenta pigments, Pigment Red 185, 238, Pigment Red 269, and Pigment Red 122 may be used in terms of manufacturing properties and charging ability.

Examples of a cyan pigment as a colorant that may be used in a toner according to an embodiment of the present general inventive concept include Prussian Blue, Cobalt Blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green, Malachite Green Oxalate, and the like. In particular, C.I. Pigment Blue 15:1 or C.I. Pigment Blue 15:3 may be used.

Examples of a black pigment as a colorant that may be used in a toner according to an embodiment of the present general inventive concept include carbon black, copper oxides, manganese dioxide, aniline black, activated carbon, and the like. In particular, the black pigment may be carbon black. A dispersibility of carbon black is relatively good, and thus, it does not require a dispersing process. However, carbon black prepared by using a method of preparing a color colorant may be used.

The colorant used in the toner may be selected by considering color, chroma, luminosity, weather resistance, OHP transparency, and dispersibility in the toner. The colorant may be added to the toner in an amount of about 4 to about 15 mass % based on the total weight of solids constituting the toner.

(Releasing Agent)

A releasing agent increases low-temperature fixability and abrasion resistance of the toner and final image durability, and thus, the type and amount of the releasing agent play an important role in determining toner characteristics. The releasing agent may be a natural wax or a synthetic wax. The type of the releasing agent is not limited thereto, and may be selected from the group consisting of a polyethylene-based wax, a polypropylene-based wax, a silicone wax, a paraffin-based wax, an ester-based wax, carnauba wax and a metallocene wax. A melting temperature of the releasing agent may be in the range of 60° C. to 100° C., for example, 70° C. to 90° C. The releasing agent physically adheres to the toner particles, but does not covalently bond with the toner particles.

The amount of the releasing agent may be, for example, about 1 to about 20 parts by weight, about 2 to about 16 parts by weight, or about 3 to about 12 parts by weight, based on 100 parts by weight of the toner. If the amount of the releasing agent is 1 part by weight or more, a low-temperature fixability of the toner is obtained and a fixing temperature latitude is secured. If the amount of the releasing agent is 20 parts by weight or less, storage ability of the toner may be improved, and the toner may be economically used.

A releasing agent used in a toner according to an embodiment of the present general inventive concept may include an ester group-containing ester-based wax, but is not limited thereto. When the ester-based wax is used, a compatibility between the crystalline polyester resin and the releasing agent increases, and thus, a melting behavior of the toner may be improved. Accordingly, low-temperature fixability, image durability, and abrasion resistance of the toner may be improved. Examples of the ester-based wax include a mixture of an ester-based wax and a non-ester-based wax; and an ester group-containing wax prepared by adding an ester group to a non-ester-based wax. Since the ester group has high affinity with a binder resin latex component of the toner, the wax may be uniformly distributed throughout the toner particles to effectively exhibit wax effects. The non-ester-based wax components may suppress excessive plasticization that may occur when only the ester-based wax is present, due to a releasing effect of the binder resin latex. As a result, the mixture of an ester-based wax and a non-ester-based wax may maintain good developability of the toner for a long period of time. Examples of the ester-based wax may include esters of fatty acids having a carbon number of about 15-30 with a mono- to pentavalent alcohol, such as behenyl behenate, stearyl stearate, pentaerythritol stearate, glyceryl montanate, etc. The alcohol component constituting the ester may be a monovalent alcohol with a carbon number of 10-30 or a polyhydric alcohol with a carbon number of about 3-10. Examples of the non-ester-based wax include a polyethylene-based wax, a polypropylene-based wax, a silicone wax, and a paraffin-based wax.

Examples of the ester group-containing wax may include a mixture of a paraffin-based wax and an ester-based wax; and an ester group-containing paraffin-based wax. A specific example thereof may include P-212, P-280, P-318, P-319, P-419 and P-420 (manufactured by CHUKYO YUSHI CO., LTD.). When the releasing agent is a mixture of a paraffin-based wax and an ester-based wax, an amount of the ester-based wax may be in the range of about 1 wt % to about 50 wt %, about 5 to about 50 wt %, about 7 to about 50 wt %, about 10 to about 50 wt %, or about 15 to about 50 wt %, based on the total weight of the paraffin-based wax and the ester-based wax. When the amount of the ester-based wax is 1 wt % or more, compatibility of the releasing agent with a binder resin latex may be sufficiently maintained. On the other hand, when the amount of the ester-based wax is 50 wt % or less, plasticizing characteristics of the toner are appropriately controlled and the toner retains developability for a long period of time. In the present toner, the releasing agent may be selected such that a solubility parameter (SP) value of the binder resin has a difference of about 2 or more when compared with an SP value of the paraffin-based wax and an SP value of the ester-based wax. If the SP difference is small, a plasticization phenomenon may occur between the binder resin and the releasing agent.

(Other Additives)

In the toner according to an embodiment of the present general inventive concept, inorganic or organic particles may be added. Due to reinforcing effects of the particles, the toner may have an increased storage modulus, an improved anti-offset property, and an improved peeling property from a fixing unit. In addition, the particles may improve the dispersibility of an internal additive such as a colorant, a releasing agent, or the like.

As for the inorganic particles, silica, hydrophobically-treated silica, alumina, titanium oxides, calcium carbonate, magnesium carbonate, tricalcium phosphate, colloidal silica, an alumina-treated colloidal silica, a cation surface-treated colloidal silica, an anion surface-treated colloidal silica, and the like may be used alone or in combination. Among these inorganic particles, colloidal silica may be used in terms of OHP transparency and dispersibility in the toner. The particle diameter of the inorganic particles may be in the range of about 5 to about 50 nm. Also, particles differing in the particle diameter may be used in combination. The particles may be directly added at the production of the toner but may be used by previously dispersing them in a water-soluble medium such as water by using an ultrasonic disperser or the like. At the time of dispersing the particles, an ionic surfactant or a polymer acid or a polymer base may be used to enhance the dispersibility.

Hereinafter, the toner for developing an electrostatic charge image and a method of preparing the toner will be described in more detail. An emulsion aggregation method may be used to prepare the toner.

The emulsion aggregation method is a production method including a process of forming aggregated particles in a dispersion having at least resin particles dispersed therein (hereinafter, referred to as an "emulsified liquid") to prepare an aggregated particle dispersion (aggregating process), and a process of heating the aggregated particle dispersion to fuse the aggregated particles (fusing process). Furthermore, a process of adding and mixing a particle dispersion having particles dispersed therein, in the aggregated particle dispersion to adhere particles to the aggregated particles and form adhered particles (adhering process) may be provided between the aggregating process and the fusing process. In the adhering process, the particle dispersion is added and mixed in the aggregated particle dispersion prepared in the aggregating process to adhere the particles to the aggregated particles and form adhered particles, but in relation to the aggregated particles, the particles added corresponds to particles newly added to the aggregated particles and therefore, may be referred to as "addition particles."

Other than the resin particles, examples of the addition particles include releasing agent particles and colorant particles, and one of these particles may be used alone or a plurality thereof may be used in combination. The method for adding and mixing the particle dispersion is not particularly limited, and the dispersion may be added gradually and continuously or may be added stepwise in parts a plurality of times. Consequently, by adding and mixing the particles (addition particles), the formation of very small particles is suppressed to render particle diameter distribution of the obtained toner particles sharp and the process contributes to a high-quality image. In addition, by providing the aforementioned adhering process, a pseudo-shell structure may be formed. As a result, an exposure of an internal additive such as a colorant or a releasing agent to the surface of the toner may be reduced, thus improving the charging property and lifetime of the toner. In addition, the particle diameter distribution at the fusing process may be maintained and a variation thereof may be suppressed. At the same time, it is unnecessary to add a stabilizing agent such as a surfactant, a base, an acid, or the like used to increase the stability of the toner in the fusing process or an amount of the stabilizing agent added may be minimized. In addition, manufacturing costs may be reduced and the quality of the toner may be improved.

In a toner according to an embodiment of the present general inventive concept, a core-shell structure may be formed by an operation of adding the above-described addition particles. The binder resin, which is a main component of the addition particles, is a resin of a shell layer. Use of this method may facilitate controlling the shape of the toner by adjusting the temperature, stirring number, pH, or the like in the fusing process.

In the emulsion aggregation method, when an amorphous polyester resin or a crystalline polyester resin is used, a process of emulsifying the amorphous polyester resin to form emulsified particles (liquid droplet), for example, may be appropriately used.

In the emulsifying process, the emulsified particles (liquid droplet) of the amorphous polyester resin is formed by applying a shear force to a solution that is a mixture containing an aqueous medium, the polyester resin, and, if desired, a colorant-containing mixed solution (polymer solution). At this time, the emulsified particles may also be formed by decreasing the viscosity of the polymer solution while heating to a temperature not lower than the glass transition temperature of the amorphous polyester resin. Also, a dispersing agent may be used to stabilize the emulsified particles or increase the viscosity of the aqueous medium. Hereinafter, the dispersion of such emulsified particles may be referred to as a "resin particle dispersion."

A phase inversion emulsification method may also be used in forming the emulsified particles. The phase inversion emulsification method is a process of dissolving at least a polyester resin in an organic solvent, adding, if desired, a neutralizer or a dispersion stabilizing agent, adding dropwise an aqueous medium while stirring to obtain emulsified particles, and removing the organic solvent in the resin dispersion to obtain an emulsified liquid. In this regard, the order in which a neutralizer and a dispersion stabilizing agent are charged may be changed.

Examples of the organic solvent used to dissolve the polyester resin include esters of formic acid, esters of acetic acid, esters of butyric acid, ketones, ethers, benzenes, and halogenated carbons. Specific examples thereof include esters of formic acid, acetic acid, or butyric acid, such as methyl, ethyl, n-propyl, isopropyl, n-butyl, isobutyl, sec-butyl and tert-butyl esters thereof; methyl ketones such as acetone, methyl ethyl ketone (MEK), methyl propyl ketone (MPK), methyl isopropyl ketone (MIPK), methyl butyl ketone (MBK), and methyl isobutyl ketone (MIBK); ethers such as diethyl ether and diisopropyl ether; aromatic compounds such as toluene, xylene, and benzene; and halogenated carbons such as carbon tetrachloride, methylene chloride, 1,2-dichloroethane, 1,1,2-trichloroethane, trichloroethylene, chloroform, monochlorobenzene, and dichloroethylidene. One of these solvents may be used alone, or two or more thereof may be used in combination. Among these organic solvents, esters of acetic acid, methyl ketones, and ethers, which are low boiling temperature solvents, may be generally used in terms of good availability, ease of recovery during desolvation, and environmentally-friendly properties. In particular, acetone, MEK, acetic acid, ethyl acetate, or butyl acetate may be used. The organic solvent may be a solvent having a relatively high volatility so as not to remain in the resin particles, because the organic solvent remaining in the resin particles is a material that causes a volatile organic compound (VOC). The amount of the organic solvent used may be from about 20 to about 200 mass %, for example, from about 30 to about 100 mass %, based on the amount of the resin.

As the aqueous medium, water such as an ion-exchanged water, is generally used, but a water-soluble organic solvent may also be used to the extent that it does not collapse an oil droplet. Examples of the water-soluble organic solvent include lower carbon chain alcohols such as methanol, ethanol, 1-propanol, 2-propanol, 1-butanol, 2-butanol, tert-butanol, and 1-pentanol; ethylene glycol monoalkyl ethers such as ethylene glycol monomethyl ether, ethylene glycol monoethyl ether, and ethylene glycol monobutyl ether; ethers; diols; tetrahydrofuran (THF); and acetone. In particular, ethanol or 2-propanol may be used. The amount of the water-soluble organic solvent may be in the range of about 1 to 60 mass %, for example, about 5 to about 40 mass % based on the amount of the resin. The water-soluble organic solvent may be used not only by mixing water-soluble organic solvent with ion-exchanged water, but also by adding water-soluble organic solvent to a solution in which the resin is dissolved. When the water-soluble organic solvent is added to the resin solution, a wettability between the resin and the resin solution may be adjusted, and a reduction in the viscosity of the resultant solution after the resin is dissolved may be expected.

Also, if desired, a dispersing agent may be added to the resin solution and the aqueous component so as to maintain a dispersing state of the emulsified liquid stable. Examples of the dispersing agent include a dispersion stabilizing agent that forms a hydrophilic colloid in the aqueous component, such as cellulose derivatives (e.g., hydroxymethyl cellulose, hydroxyethyl cellulose, hydroxypropyl cellulose, and the like), synthetic polymers (e.g., polyvinyl alcohol, polyvinylpyrrolidone, polyacrylamide, polyacrylamide, polyacrylate salt, and polymethacrylate), gelatin, gum Arabic and agar. Also, a solid powder such as silica, titanium oxides, alumina, tricalcium phosphate, calcium carbonate, calcium sulfate, and barium carbonate may be used. The dispersion stabilizing agent may be generally added such that the concentration in the aqueous component may be from about 0 to about 20 mass %, for example, from about 0 to about 10 mass %. Also, the dispersing agent may be a surfactant. With respect to the surfactant, the surfactants used for a colorant dispersion described below may be used. Examples of the surfactant include a natural surfactant component such as saponin, a cationic surfactant such as alkylamine hydrochloride/acetate salts, quaternary ammonium salts, and glycerins, and an anionic surfactant such as fatty acid soaps, sulfuric acid esters, alkylnaphthalene sulfonates, sulfonates, phosphoric acids, phosphoric acid esters, and sulfosuccinates. Among these surfactants, an anionic surfactant or a non-ionic surfactant may be used. In order to adjust the pH of the emulsified liquid, a neutralizer may also be added. Examples of the neutralizer include an acid and an alkali in general, such as acetic acid, hydrochloric acid, sodium hydroxide and ammonia.

With respect to the method of removing the organic solvent from the emulsified liquid, a method of heating the emulsified liquid at a temperature of about 15° C. to about 70° C. to volatilize the organic solvent, or a pressure-reducing method may be used together with the volatilizing method.

A method of dispersing the colorant or releasing agent is not particularly limited, and, for example, a general disperser such as a high-pressure homogenizer, a rotary shearing-type homogenizer, an ultrasonic disperser, a high-pressure counter collision disperser, and a media-containing mill (e.g., ball mill, sand mill, Dyno mill) may be used.

If desired, a water dispersion of the colorant may be prepared using a surfactant, or an organic solvent dispersion of the colorant may be prepared using a dispersing agent. Hereinafter, the dispersion of the colorant and releasing agent may be referred to as a "colorant dispersion" or a "releasing agent dispersion".

The dispersing agent used in the colorant dispersion or releasing agent dispersion is generally a surfactant. Examples of the surfactant include an anionic surfactant such as sulfuric acid esters, sulfonates, phosphoric acid esters, fatty acid soaps; a cationic surfactant such as amine salt type and quaternary ammonium salt type; and a nonionic surfactant such as polyethylene glycol type, alkyl phenol ethylene oxide adduct type, and polyhydric alcohol type. Among these surfactants, an ionic surfactant may be used. In particular, an anionic surfactant and a cationic surfactant may be used.

The nonionic surfactant may be used in combination with the anionic surfactant or cationic surfactant. One of these surfactants may be used alone, or two or more thereof may be used in combination. The dispersing agents used in the colorant dispersion and the releasing agent dispersion may have the same polarity.

Specific examples of the anionic surfactant include fatty acid soaps such as potassium laurate, sodium oleate, and sodium castor oil; sulfuric acid esters such as octyl sulfate, lauryl sulfate, lauryl ether sulfate, and nonyl phenyl ether sulfate; sulfonates such as lauryl sulfonate, dodecyl sulfonate, dodecylbenzene sulfonate, sodium alkylnaphthalenesulfonate (e.g., sodium triisopropylnaphthalene sulfonate, sodium dibutylnaphthalene sulfonate), naphthalene sulfonate formalin condensate, monooctyl sulfosuccinate, dioctyl sulfosuccinate, lauric acid amide sulfonate, and oleic acid amide sulfonate; phosphoric acid esters such as lauryl phosphate, isopropyl phosphate, and nonyl phenyl ether phosphate; sulfosuccinates such as sodium dialkylsulfosuccinate (e.g., sodium dioctylsulfosuccinate), disodium lauryl sulfosuccinate, and disodium lauryl polyoxyethylenesulfosuccinate. Of these, an alkylbenzene sulfonate-based compound such as dodecylbenzene sulfonate and its branched form may be used.

Specific examples of the cationic surfactant include amine salts such as laurylamine hydrochloride, stearylamine hydrochloride, oleylamine acetate, stearylamine acetate, and stearylaminopropylamine acetate; and quaternary ammonium salts such as lauryltrimethylammonium chloride, dilauryldimethylammonium chloride, distearylammonium chloride, distearyldimethylammonium chloride, lauryldihydroxyethylmethylammonium chloride, oleylbispolyoxyethylenemethylammonium chloride, lauroylaminopropyldimethylethylammonium sulfate, lauroylaminopropyldimethylhydroxyethylammonium perchlorate, alkylbenzenedimethylammonium chloride, and alkyltrimethylammonium chloride.

Specific examples of the nonionic surfactant include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate, and polyoxyethylene oleate; alkylamines such as polyoxyethylene laurylamino ether, polyoxyethylene stearylamino ether, polyoxyethylene oleylamino ether, polyoxyethylene soybean amino ether, and polyoxyethylene tallow amino ether; alkylamides such as polyoxyethylene lauric acid amide, polyoxyethylene stearic acid amide, and polyoxyethylene oleic acid amide; vegetable oil ethers such as polyoxyethylene castor oil ether and polyoxyethylene rapeseed oil ether; alkanolamides such as lauric acid diethanolamide, stearic acid diethanolamide, and oleic acid diethanolamide; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The amount of the dispersing agent used may be equal to or greater than about 2 and equal to or less than about 30 mass %, for example, equal to or greater than about 5 and equal to or less than about 20 mass %, based on the mass of the colorant or the releasing agent. When the amount of the dispersing agent is too small, the particle diameter of the toner does not decrease or storage stability of the dispersion may deteriorate. On the other hand, when the amount of the dispersing agent is too large, the amount of the dispersing agent remaining in the toner increases and the charging ability and/or powder fluidity of the toner may be reduced.

An aqueous dispersion medium used may be a medium containing little impurities (e.g., metal ions), such as distilled water or ion-exchanged water. Also, an alcohol or the like may be added to provide anti-foaming or the adjustment of the surface tension of the toner. In addition, polyvinyl alcohol or a cellulose-based polymer may be added to adjust the viscosity of the toner, but may be used in a minimized amount since if the polyvinyl alcohol or a cellulose-based polymer remains in the toner, the charging ability of the toner is reduced.

A means to produce a dispersion of various additives described above is not particularly limited, and examples thereof include a dispersing apparatus that may be used to prepare the colorant dispersion or the releasing agent dispersion, such as a rotary shearing-type homogenizer, a media-containing mill (e.g., ball mill, sand mill, Dyno mill).

In the aggregating process, an aggregating agent to form aggregated particles may be used. The aggregating agent may be a surfactant having a polarity inverse to that of the surfactant used for the dispersing agent, and an inorganic metal compound (an inorganic metal salt) or a polymer thereof may be generally used as the aggregating agent. The metal element constituting the inorganic metal salt is a metal element having a divalent or higher electric charge belonging to Groups 2A, 3A, 4A, 5A, 6A, 7A, 8, 1B, 2B and 3B of the Periodic Table (the long Periodic Table), and any metal element that is dissolved and is in the form of an ion in the aggregated system of resin particles may be used.

Specific examples of the inorganic metal salt include a metal salt such as calcium chloride, calcium acetate, barium chloride, magnesium chloride, zinc chloride, aluminum chloride, and aluminum sulfate; and an inorganic metal salt polymer such as polyaluminum chloride, polyaluminum hydroxide, and calcium polysulfide. Among these inorganic metal salts, an aluminum salt and a polymer thereof may be used. In general, to obtain a sharper particle size distribution, the valence of the inorganic metal salt may be divalence over monovalence, and trivalence or greater valence over divalence. With the same valence, a polymer type, that is, an inorganic metal salt polymer, may be used.

Instead of an aluminum-based aggregating agent, an iron-based aggregating agent, in particular, a polysilicate iron aggregating agent or "Polysilicato-Iron" aggregating agent containing Si and Fe which is prepared by combining a polymer of silica with ferric chloride, may be used in terms of environmentally-friendly properties, non-toxicity to humans, and the like. The polysilicate iron containing Si and Fe may also exhibit a strong aggregation force during an aggregating process, uniform control of a particle size and may control a shape of aggregated toner particles.

In particular, the polysilicate iron aggregating agent may be available under the trade names of PSI-025, PSI-050, PSI-085, PSI-100, PSI-200, and PSI-300 (SUIDO KIKO KAISHA LTD.). PSI is an abbreviation of "Polysilicato-Iron". The metal salts containing Si and Fe exhibit a strong aggregation force even at a lower temperature and in a smaller amount of aggregating agent as compared to the aggregating agents used in a typical emulsion-aggregation (EA) method. Above all, since these metal salts use iron and silica as main components, effects of residual aluminum on the environment and the human body, which are limitations of typical trivalent aluminum polymer aggregating agents, may be minimized.

The amount of the aggregating agent varies depending on the kind or valence of the aggregating agent, but, in general, the amount thereof is in the range of 0.05 to 0.1 mass %. The aggregating agent flows out into the aqueous medium or forms coarse particles in the process of producing a toner, and thus, the entire amount thereof does not remain in the toner. In particular, when the amount of a solvent in the resin is large, the aggregating agent readily interacts with the solvent in the process of producing a toner, and thus, easily flows out into the aqueous medium. Therefore, the amount of the aggregating agent is required to be adjusted in accordance with the amount of the remaining solvent.

Mainly due to the addition of an aggregating agent, the toner may include iron. The amount of the iron may be about 0.01% to about 0.8% in terms of the compositional ratio of elements. In addition, when a silicon intensity and an iron intensity determined by X-ray fluorescence (XRF) measurement are denoted as [Si] and [Fe], respectively, an [Fe]/[Si] ratio of the toner may satisfy the following condition: 0.2< [Fe]/[Si]<1.3. In addition, when a total iron intensity included in the toner which is determined by X-ray fluorescence (XRF) measurement and an intensity of an iron present on the surface of the toner which is determined by X-ray photoelectron spectroscopy (XPS) are denoted as [Fe1] and [Fe2], respectively, an [Fe2]/[Fe1] ratio of the toner may satisfy the following condition: 0.05≤[Fe2]/[Fe1]≤0.5. In this regard, [Si], [Fe], and [Fe1] are values measured by XRF described below, and [Fe2] is a value measured by X-ray photoelectron spectroscopy (XPS) described below.

When the [Fe]/[Si] ratio and the [Fe2]/[Fe1] ratio are within the ranges described above, the metal elements are ionically cross-linked with polar components of the polyester resin to increase the strength of a fixed image, resulting in improved anti-hot-offset properties. On the other hand, when the amounts of the metal elements are too large, melt viscosity may increase, gloss of a fixed image may be reduced, and low-temperature fixability may be decreased. That is, by adjusting the amount of a used aggregating agent to control the amounts of the metal elements present on the surface of the toner and inside the toner, a toner with satisfactory low-temperature fixability, a satisfactory anti-hot-offset property, and a high heat storage ability may be obtained.

In the fusing process, pH of a suspension of aggregates is adjusted to 5 to 10 while stirring as in the aggregating process, thus stopping the progress of aggregation, and the suspension is then heated at a temperature not lower than the glass transition temperature (Tg) of the resin (or at a temperature not lower than the melting temperature of the crystalline resin) to fuse and coalesce the aggregated particles. The heating time meets a required amount of heating if the heating time allows the desired coalescence, and may be, for example, 0.2 to 10 hours. Afterwards, the aggregated particles are solidified by cooling to Tg of the resin or less. In this regard, the shapes and surface properties of the particles vary depending on the temperature drop rate. If the cooling process is performed at a rapid rate, the tonerparticles are spherized, and the surfaces of the toner particles have less irregularities. On the other hand, if the cooling process is slowly performed, the toner particles have an irregular shape, and the surfaces of the toner particles are likely to be rough. Hence, the cooling process may be performed up to Tg of the resin at a cooling rate of at least 0.5° C./min, for example, at a cooling rate of at least 1.0° C./min.

Also, the aggregating process and the fusing process may be simultaneously performed such that particles are grown by the control of pH or addition of the aggregating agent in accordance with the aggregating process while heating the particles at a temperature not lower than Tg of the resin. At the point of reaching a desired particle diameter, the temperature is lowered to Tg of the resin or less at a rate of at least 0.5° C./min in accordance with the case of the fusing process to simultaneously stop the solidification and the growth of the particles. This process simplifies the manufacturing processes, but it may be difficult to form the core-shell structure described above.

After the fusing process is completed, the particles are washed and dried to obtain toner particles. Considering the charging ability of the toner, replacement washing with ion-exchanged water may be performed. The degree of washing is generally monitored by the conductivity of a filtrate, and the washing may be performed so that the conductivity of the filtrate finally reaches 10 μS/cm or less. In the washing process, a process of neutralizing ions with an acid or an alkali may be also performed. In this regard, the treatment with an acid may be performed at a pH of 4.0 or less, and the treatment with an alkali may be performed at a pH of 8.0 or more. Solid-liquid separation after the washing process is not particularly limited, and suction filtration or pressure filtration such as filter press may be used in view of productivity. A drying process is not particularly limited, and freeze drying, flash jet drying, fluidized drying, or vibration-type fluidized drying may be performed in view of productivity. The drying process may be performed so that a final toner has a moisture percentage of about 1 mass % or less, for example, about 0.7 mass % or less.

To the toner particles obtained using the preparation method described above, inorganic particles and organic particles such as a flowing aid, a cleaning aid, an abrasive, or the like may be externally added. Examples of the inorganic particles include all of the particles usually used as an external additive on the toner surface, such as silica, alumina, titanium oxides, calcium carbonate, magnesium carbonate, tricalcium phosphate, and cerium oxides. In particular, inorganic particles having a hydrophobically-treated surface may be used. Examples of the organic particles include general toner external additives, such as a vinyl-based resin (e.g., a styrene-based polymer, a (meth)acrylic polymer, an ethylene-based polymer), a polyester resin, a silicone resin, and a fluorine-based resin.

The inorganic and organic particles are added to improve a transferring property of the toner, and a primary particle diameter of such a particle may be in the range of about 0.01 to about 0.5 μm. A lubricant may be also added to the toner. Examples of the lubricant include fatty acid amides such as ethylene bis-stearamide and oleamide, and fatty acid metal salts such as zinc stearate and calcium stearate. The lubricant is generally added to improve a cleaning property of the toner, and a primary particle diameter of the lubricant may be in the range of about 0.5 to about 8.0 μm. In particular, silica, alumina, or titanium oxides may be used. Particularly, hydrophobically-treated silica may be added as an essential component. For example, silica and titanium oxides may be used in combination. When an inorganic particle having a diameter of about 80 to about 500 nm is used in combination, the transferring property of the toner may be improved. A hydrophobe used to hydrophobically treat the external additive is not particularly limited, and examples of the hydrophobe include coupling agents such as a silane-based coupling agent, a titanate-based coupling agent, an aluminate-based coupling agent, a zirconium-based coupling agent, and the like, a silicone oil, and a polymer coating agent. The external additive is adhered to or fixed on the surface of the toner by applying a mechanical impact by using a sample mill or a Henschel mixer.

(Physical Properties of Toner)

A toner according to an embodiment of the present general inventive concept may have a volume average particle diameter of about 4 to about 9 μm, for example, about 4.5 to about 8.5 μm, for example, about 5 to about 8 μm. When the volume average particle diameter of the toner is less than about 4 μm, fluidity of the toner deteriorates, the charging ability of each toner particle may be reduced, and charging distribution becomes wide, and thus, fogging of the background and leakage of the toner from a developing unit is likely to occur. In addition, a cleaning property of the toner may be poor. On the other hand, when the volume average particle diameter of the toner is greater than about 9 μm, resolution of the toner decreases, and thus, it is difficult to obtain a high-quality image.

The toner may have a volume average particle size distribution index GSDv of about 1.05 to about 1.30, for example, about 1.05 to about 1.25.

The volume average particle size distribution index GSDv may be measured as follows. That is, the volume average particle size distribution index GSDv, which is a particle size distribution index of toner particles, is measured under the following conditions by using a Multisizer III measuring device (available from BECKMAN COULTER, INC.) which is a Coulter counter.

Electrolyte: ISOTON II

Aperture diameter: 50 μm

Measured particle number: 30,000

From the measured particle size distribution of the toner, a cumulative distribution for volume and number of respective toner particles was plotted as a divided particle size range (i.e., channel) in order of increasing diameter. A particle diameter at cumulative 16% is defined as volume average particle size D16v, and a diameter at cumulative 50% is defined as volume average particle size D50v. Similarly, a particle diameter at cumulative 84% is defined as volume average particle size D84v. GSDv is calculated by using the following equation:

$$GSDv=(D84v/D16v)^{0.5}.$$

In this regard, the measurement is performed after the toner is dispersed in an aqueous electrolytic solution (an aqueous ISOTON II solution) (concentration: 5 mass %) and ultrasonically dispersed for 30 seconds or more.

An absolute value of a charging amount of the toner may be in the range of about 15 to about 70 μC/g, for example, about 30 to about 55 μC/g. When the absolute value of the charging amount of the toner is less than about 15 μC/g, contamination of the background portion of the image may occur. On the other hand, when the absolute value of the charging amount of the toner is greater than about 70 μC/g, the density of a final image may decrease. In addition, a ratio (HH/LL) of a charging amount under high temperature and high humidity (HH) (i.e., 30° C. and 80RH %) to a charging amount under low temperature and low humidity (LL) (i.e., 10° C. and 10RH %) may be in the range of about 0.5 to about 1.5, for example, about 0.7 to about 1.2. When the HH/LL ratio is within these ranges, the toner may not be affected by the surrounding conditions and a clear image may be obtained.

In addition, the toner may include about 1 mass % or less of an ethyl acetate insoluble fraction, e.g., a gel fraction, based on the amount of the binder resin. If the amount of the gel fraction is large, an anti-offset property of the toner is improved, while a gloss property of an image may deteriorate. The content of the gel fraction may be measured as follows. About 2.5 g of resin and about 47.5 g of ethyl acetate are stirred together at 25±3° C. for 12 hours and soluble fractions are completely dissolved to prepare a solution. The concentration of the solution is represented as RC. Subsequently, the obtained solution is maintained for 16 hours. An insoluble part and a supernatant are separated from the solution, and the concentration of the supernatant SC is analyzed. The concentration of the supernatant SC is calculated from a measurement value of the mass of a residual resin obtained by collecting 5 g of the supernatant and drying the supernatant at 150° C. for 1 hour to remove ethyl acetate. The content of the gel fraction is obtained from the RC and SC values by using the following equation:

$$\text{Gel fraction content}=[(RC-SC)/RC]\times 100(\%).$$

The present general inventive concept will now be described in further detail with reference to the following examples. These examples are provided only for illustrative purposes and are not intended to limit the scope of the present general inventive concept.

EXAMPLES

A toner is prepared using the following method. First, a resin dispersion, a colorant dispersion, and a releasing agent dispersion are respectively prepared. Subsequently, these dispersions were mixed in predetermined amounts and a metal salt aggregating agent was added thereto while being stirred to ionically neutralize the resultant mixture, thus forming aggregated particles of the respective particles. Then, pH of the resultant medium was adjusted using an inorganic hydroxide to be in a range from a weak acidic range to a neutral range, and the resultant medium is heated at a glass transition temperature or more of the resin particles (or melting point or more) to allow the aggregated particles to be fused. When the reaction is completed, the particles are sufficiently washed, subjected to solid-liquid separation, and dried to obtain desired toner particles. Unless otherwise defined below with regards to the term "parts," "parts" indicates "parts by mass."

<Measurement Methods of Physical Properties of Toner>

Hereinafter, methods of measuring physical properties of toners prepared according to the following Examples and Comparative Examples will be described. A detailed description thereof that has been already provided above and thus will not be provided here.

(Measurement of Molecular Weight and Molecular Weight Distribution of Resin)

A Waters 2695, Waters 2414 RI detector (manufactured by WATERS CORPORATION) is used as a GPC apparatus, three columns (Model: Styragel HR2, HR4, and HR5 (7.8 mm×300 mm)) are used, and tetrahydrofuran (THF) is used as a carrier solvent.

(Volume Average Particle Diameter of Resin Particles and Colorant Particles Etc.)

A volume average particle diameter of each of resin particles and colorant particles etc. was measured using Microtrac Bluewave (MICROTRAC INC.).

(Measurement of Melting Temperature and Glass Transition Temperature of Resin)

A melting temperature of a crystalline resin and a glass transition temperature (Tg) of an amorphous resin were measured under the above-described conditions by using a differential scanning calorimetry (DSC Q2000 manufactured by TA INSTRUMENTS) in accordance with ASTM D3418-8. As described above, the melting temperature and the Tg were determined as a temperature corresponding to an intersection point obtained by extending a straight line portion before the phase transition and a straight line portion in the middle of the phase transition.

<X-Ray Fluorescence (XRF) Measurement Method: [Fe1]>

3 g of a toner sample was formed by using a press-former under the following conditions: a pressing load of 2t and a pressing time of 10 seconds, and [Fe1] was measured using an X-ray fluorescence spectrometer (EDX-720) manufactured by SHIMADZU CORPORATION. The measurement was performed under the conditions of a tube voltage of 15 kV and a tube electrical current of 100 μA, and [Fe1] was obtained from an elemental composition ratio.

<XPS Measurement Method: [Fe2]>

[Fe2] of the toner sample was measured using an X-ray photoelectron spectrometer (ULVAC-PHI INC. S5000). The measurement conditions were as follows: X-ray source of MgKα (400 W) and an analysis area of 0.8×2.0 mm.

<Preparation of Dispersions>

Mol % described below is a value based on a total number of moles of a diol component (i.e., 100 mol %) used to polymerize a polyester.

(Amorphous Polyester Resin A-1)

35.0 mol % of a bisphenol A-ethylene oxide (2 mol) adduct (BisA-EO), 65.0 mole % of a bisphenol A-propylene oxide (2 mol) adduct (BisA-PO), 73.0 mol % of terephthalic acid (TPA), 15.0 mol % of dodecenylsuccinic anhydride (DDSA), and 8.0 mol % of trimellitic anhydride (TMA) were added into a 3 L (3 liter) four-necked flask equipped with a reflux condenser, a water separator, a nitrogen gas-introducing pipe, a thermometer, and a stirrer. In addition, titanium lactate (available from MATSUMOTO PHARMACEUTICAL MANUFACTURE CO., LTD., trade name: Orgatics TC-310) was added to the resultant mixture in an amount of 0.17 parts by mass based on 100 parts by mass of the monomers (the diol component+the diacid component).

While a nitrogen gas was introduced into the four-necked flask, the resulting mixture was subjected to dehydration-polycondensation at 180° C. to 250° C. for about 6 to 7 hours and the temperature was lowered to 220° C. Then, 5.2 mol % of TMA was further added to the flask and maintained for about 1 hour to induce a reaction therebetween. At a point when an acid value of the reaction product reached a value shown in Table 1, the reaction product was taken out from the flask, cooled, and pulverized to obtain an amorphous polyester resin A-1.

(Amorphous Polyester Resin A-2)

An amorphous polyester resin A-2 was prepared using the same method as that used to prepare the amorphous polyester resin A-1, except that 5.2 mol % of TMA was added at 200° C. and maintained for 1 hour to induce a reaction therebetween.

(Amorphous Polyester Resin A-3)

35.0 mol % of a bisphenol A-ethylene oxide (2 mol) adduct (BisA-EO), 65.0 mole % of a bisphenol A-propylene oxide (2 mol) adduct (BisA-PO), 86.8 mol % of TPA, 10.0 mol % of DDSA, and 5.5 mol % of TMA were added into a 3 L (3 liter) four-necked flask equipped with a reflux condenser, a water separator, a nitrogen gas-introducing pipe, a thermometer, and a stirrer. In addition, titanium lactate (trade name: Orgatics TC-310) was added to the resultant mixture in an amount of 0.17 parts by mass based on 100 parts by mass of the monomers (the diol component+the diacid component).

While a nitrogen gas was introduced into the four-necked flask, the resulting mixture was subjected to dehydration-polycondensation at 180° C. to 250° C. for about 6 to 7 hours and the temperature was lowered to 220° C. Then, 2.5 mol % of TMA was further added to the flask and maintained for about 1 hour to induce a reaction therebetween. At a point when an acid value of the reaction product reached a value shown in Table 1, the reaction product was taken out from the flask, cooled, and pulverized to obtain an amorphous polyester resin A-3.

(Amorphous Polyester Resin A-4)

35.0 mol % of a bisphenol A-ethylene oxide (2 mol) adduct (BisA-EO), 65.0 mole % of a bisphenol A-propylene oxide (2 mol) adduct (BisA-PO), 72.3 mol % of TPA, 15.0 mol % of DDSA, and 8.5 mol % of TMA were added into a 3 L (3 liter) four-necked flask equipped with a reflux condenser, a water separator, a nitrogen gas-introducing pipe, a thermometer, and a stirrer. In addition, titanium lactate (trade name: Orgatics TC-310) was added to the resultant mixture in an amount of 0.17 parts by mass based on 100 parts by mass of the monomers (the diol component+the diacid component).

While a nitrogen gas was introduced into the four-necked flask, the resulting mixture was subjected to dehydration-polycondensation at 180° C. to 250° C. for about 6 to 7 hours and the temperature was lowered to 220° C. Then, 5.2 mol % of TMA was further added to the flask and maintained for 2 hours to induce a reaction therebetween. At a point when an acid value of the reaction product reached a value shown in Table 1, the reaction product was taken out from the flask, cooled, and pulverized to obtain an amorphous polyester resin A-4.

TABLE 1

| | Amorphous polyester resin A-1 | Amorphous polyester resin A-2 | Amorphous polyester resin A-3 | Amorphous polyester resin A-4 |
|---|---|---|---|---|
| Weight average molecular weight (g/mol) | 41,000 | 38,000 | 23,000 | 54,000 |
| Main peak molecular weight (g/mol) | 14,500 | 13,000 | 12,000 | 18,000 |
| Acid value (mg KOH/g) | 12.5 | 12.9 | 11.8 | 12.0 |
| Tg (° C.) | 58.9 | 58.1 | 59.4 | 59.1 |

(Amorphous Polyester Resin B-1)

35.0 mol % of a bisphenol A-ethylene oxide (2 mol) adduct (BisA-EO), 65.0 mole % of a bisphenol A-propylene oxide (2 mol) adduct (BisA-PO), 90.0 mol % of TPA, and 5.0 mol % of DDSA were added into a 3 L (3 liter) four-necked flask equipped with a reflux condenser, a water separator, a nitrogen gas-introducing pipe, a thermometer, and a stirrer. In addition, titanium lactate (trade name: Orgatics TC-310) was added to the resultant mixture in an amount of 0.17 parts by mass based on 100 parts by mass of the monomers (the diol component+the diacid component).

While a nitrogen gas was introduced into the four-necked flask, the resulting mixture was subjected to dehydration-polycondensation at 180° C. to 240° C. for about 5 to 6 hours and the temperature was lowered to 200° C. Then, 6.0 mol % of TMA was added to the flask and maintained for 1 hour to induce a reaction therebetween. At a point when an acid value of the reaction product reached a value shown in Table 2, the reaction product was taken out from the flask, cooled, and pulverized to obtain an amorphous polyester resin B-1.

(Amorphous Polyester Resin B-2)

An amorphous polyester resin B-2 was prepared using the same method as that used to prepare the amorphous polyester resin B-1, except that 2.3 mol % of TMA was added at 200° C. and maintained for 1 hour to induce a reaction therebetween.

TABLE 2

| | Amorphous polyester resin B-1 | Amorphous polyester resin B-2 |
|---|---|---|
| Weight average molecular weight (g/mol) | 9,000 | 17,000 |
| Acid value (mgKOH/g) | 7.0 | 6.5 |
| Tg (° C.) | 58.1 | 62.3 |

(Crystalline Polyester Resin C-1)

100 mol % of 1,9-nonanediol (1,9-ND) and 100 mol % of 1,10-dodecanedicarboxylic acid were added into a 3 L (3 liter) four-necked flask equipped with a reflux condenser, a water separator, a nitrogen gas-introducing pipe, a thermometer, and a stirrer. In addition, titanium lactate (trade name: Orgatics TC-310) was added to the resultant mixture in an amount of 0.17 parts by mass based on 100 parts by mass of the monomers (the diol component+the diacid component).

While a nitrogen gas was introduced into the four-necked flask, the resulting mixture was subjected to dehydration-polycondensation at 180° C. to 200° C. for about 3 to 4 hours. Then, at a point when an acid value of the reaction product reached a value shown in Table 3, the reaction product was taken out from the flask, cooled, and pulverized to obtain a crystalline polyester resin C-1. The crystalline polyester resin C-1 had a weight average molecular weight of about 9,900 g/mol and a melting point of about 65.6° C.

(Crystalline Polyester Resin C-2)

A crystalline polyester resin C-2 was prepared using the same method as that used to prepare the crystalline polyester resin C-1, except that the reaction product was taken out from the flask at a point when the reaction product had an acid value of 14.0 mg KOH/g.

TABLE 3

| | Crystalline polyester resin (C-1) | Crystalline polyester resin (C-2) |
|---|---|---|
| Weight average molecular weight (g/mol) | 10,000 | 6,500 |
| Acid value (mg KOH/g) | 9.0 | 14.0 |
| Tg (° C.) | 66.5 | 62.5 |

(Amorphous Polyester Resin (A-1) Dispersion)

300 parts of the amorphous polyester resin A-1, 560 parts of MEK, and 140 parts of isopropyl alcohol (IPA) were added into a 3 L (3 liter) separable flask. The mixture was heated at 40° C. and stirred using a RZR2102 motor (available from HEIDOLPH INSTRUMENTS GMBH & CO.) to prepare a resin solution. While the resin solution was further being stirred, 15.9 parts of 5% ammonia aqueous solution was added thereto. Subsequently, 700 parts of ion-exchanged water was slowly added to the resultant solution and the organic solvents were removed therefrom by distillation to emulsify the resultant product by phase-inversion, thus obtaining an amorphous polyester resin (A-1) dispersion. A volume average particle diameter of resin particles in the amorphous polyester resin (A-1) dispersion was about 135 nm. Then, the solid concentration was adjusted to 25 mass % by using ion-exchanged water.

(Amorphous Polyester Resin (A-2) Dispersion)

An amorphous polyester resin (A-2) dispersion was prepared using the same method as that used to prepare the amorphous polyester resin (A-1) dispersion, except that the amorphous polyester resin A-2 was used and 16.4 parts of 5% ammonia aqueous solution was added. A volume average particle diameter of resin particles in the amorphous polyester resin (A-2) dispersion was about 137 nm. Then, the solid concentration was adjusted to 25 mass % by using ion-exchanged water.

(Amorphous Polyester Resin (A-3) Dispersion)

An amorphous polyester resin (A-3) dispersion was prepared using the same method as that used to prepare the amorphous polyester resin (A-1) dispersion, except that the amorphous polyester resin A-3 was used and 15.5 parts of 5% ammonia aqueous solution was added. A volume average particle diameter of resin particles in the amorphous polyester resin (A-3) dispersion was about 141 nm. Then, the solid concentration was adjusted to 25 mass % by using ion-exchanged water.

(Amorphous Polyester Resin (A-4) Dispersion)

300 parts of the amorphous polyester resin A-4, 360 parts of MEK, and 90 parts of IPA were added into a 3 L (3 liter) separable flask. The mixture was heated at 40° C. and stirred using a RZR2102 motor to prepare a resin solution. While the resin solution was further being stirred, 15.0 parts of 5% ammonia aqueous solution was added thereto. Subsequently, 700 parts of ion-exchanged water was slowly added to the resultant solution and the organic solvents were removed therefrom by distillation to emulsify the resultant product by phase-inversion, thus obtaining an amorphous polyester resin (A-4) dispersion. A volume average particle diameter of resin particles in the amorphous polyester resin (A-4) dispersion was about 150 nm. Then, the solid concentration was adjusted to 25 mass % by using ion-exchanged water.

(Amorphous Polyester Resin (B-1) Dispersion)

300 parts of the amorphous polyester resin B-1, 160 parts of MEK, and 40 parts of IPA were added into a 3 L (3 liter) separable flask. The mixture was heated at 40° C. and stirred using a RZR2102 motor to prepare a resin solution. While the resin solution was further being stirred, 19.5 parts of 5% ammonia aqueous solution was added thereto. Subsequently, 700 parts of ion-exchanged water was slowly added to the resultant solution and the organic solvent was removed therefrom by distillation to emulsify the resultant product by phase-inversion, thus obtaining an amorphous polyester resin (B-1) dispersion. A volume average particle diameter of resin particles in the amorphous polyester resin (B-1) dispersion was about 155 nm. Then, the solid concentration was adjusted to 25 mass % by using ion-exchanged water.

(Amorphous Polyester Resin (B-2) Dispersion)

An amorphous polyester resin (B-2) dispersion was prepared using the same method as that used to prepare the amorphous polyester resin (B-1) dispersion, except that 22.5 parts of 5% ammonia aqueous solution was added. A volume average particle diameter of resin particles in the amorphous polyester resin (B-2) dispersion was about 153 nm. Then, the solid concentration was adjusted to 25 mass % by using ion-exchanged water.

(Crystalline Polyester Resin (C-1) Dispersion)

300 parts of the crystalline polyester resin C-1, 160 parts of MEK, and 40 parts of IPA were added into a 3 L (3 liter) separable flask. The mixture was heated at 60° C. and stirred using a RZR2102 motor (HEIDOLPH) to prepare a resin solution. While the resin solution was further being stirred, 44 parts of 5% ammonia aqueous solution was added thereto. Subsequently, 700 parts of ion-exchanged water was slowly added to the resultant solution and the organic solvents were removed therefrom by distillation to emulsify the resultant product by phase-inversion, thus obtaining a crystalline polyester resin (C-1) dispersion. A volume average particle diameter of resin particles in the crystalline polyester resin (C-1) dispersion was about 150 nm. Then, the solid concentration was adjusted to 25 mass % by using ion-exchanged water.

(Crystalline Polyester Resin (C-2) Dispersion)

A crystalline polyester resin (C-2) dispersion was prepared using the same method as that used to prepare the crystalline polyester resin (C-1) dispersion, except that 40 parts of 5% ammonia aqueous solution. A volume average particle diameter of resin particles in the crystalline polyester resin (C-2) dispersion was about 135 nm. Then, the solid concentration was adjusted to 25 mass % by using ion-exchanged water.

(Colorant Dispersion)

60 parts of a cyan pigment (PB15:4, DAINICHISEIKA, ECB-303), 314 parts of ion-exchanged water, and 10 parts of an anionic surfactant (HS-10; DAI-ICHI KOGYO) were added into a milling bath and milling was performed at room temperature by using 400 parts of glass beads having a diameter of about 0.8 to about 1 mm to obtain a colorant dispersion. A sonifier or microfludizer may be used as a dispersing apparatus. Then, the solid concentration was adjusted to 18 mass % by using ion-exchanged water.

(Releasing Agent Dispersion)

SELOSOL P-212 (50 to 70 wt % of paraffin wax, 30 to 50 wt % of synthetic ester wax; $T_m$=72° C.; viscosity of 9 mPa·s at 25° C.) manufactured by CHUKYO YUSHI CO, LTD was used as a releasing agent dispersion. A volume average particle diameter D50 of particles of the releasing agent dispersion was about 220 nm. Then, the concentration of a solid powder of the releasing agent dispersion was adjusted to about 35.0 mass % by using ion-exchanged water.

Example 1

Preparation of Toner

Preparation of Addition Particle Dispersion

The following components were mixed and uniformly stirred to prepare an addition particle dispersion:

Amorphous polyester resin (A-1) dispersion: 87.2 parts

Amorphous polyester resin (B-1) dispersion: 203.5 parts

Anionic surfactant (DOWFAX 2A1, the amount of an effective ingredient: 47 mass %): 5.4 parts.

(Formation of Aggregates)

The following components were added into a 3 L (3 liter) reactor equipped with a thermometer, a pH meter, and a stirrer and mixed together:

Ion-exchanged water: 533.9 parts by mass

Amorphous polyester resin (A-1) dispersion: 201.8 parts

Amorphous polyester resin (B-1) dispersion: 470.8 parts

Crystalline polyester resin (C-1) dispersion: 124.6 parts

Anionic surfactant (DOWFAX 2A1, the amount of an effective ingredient: 47 mass %): 9.7 parts Colorant dispersion: 75.0 parts Releasing agent dispersion: 77.1 parts.

Subsequently, while the mixture was being stirred at 11,000 rpm using a homogenizer (IKA, JAPAN, ULTRA-TURRAX T50), 28.0 parts of an aggregating agent aqueous solution of 8.58 mass % of Polysilicato Iron was added thereto and dispersed for about 20 minutes. Then, a stirrer and a mantle heater were installed in the reactor, and the rotating number of the stirrer was adjusted so as to sufficiently stir the mixture, followed by further stirring for 20 minutes. Then, the temperature of the reactor was raised to 51.0° C. at a heating rate of 1.0° C./min, maintained at 51.0° C., and maintained for 2.5 hours while a particle diameter of particles of the mixture was measured every 15 minutes using a Multisizer II (aperture diameter: 50 μm, manufactured by. BECKMAN COULTER INC). Then, the previously prepared addition particle dispersion was added to the resultant mixture over a period of about 20 minutes. Subsequently, the mixture was maintained for 30 minutes, pH of the mixture was adjusted to about 7.8 by using a 1 N sodium hydroxide aqueous solution. Afterwards, the temperature of the mixture was raised to 81° C. at a heating rate of 0.5° C./min and maintained at that temperature. The shape of the particles was identified using a flow-type particle image analyzer (FPIA-3000: available from SYSMEX) every 30 minutes. 5 hours thereafter, it was confirmed that the particles were fused together. The temperature of the reactor was cooled to 30° C. using cooling water.

After the cooling process, the resultant slurry was passed through a mesh having an aperture of 20 μm to remove coarse particles, and the reaction product was filtered under reduced pressure by using an aspirator, followed by washing with ion-exchanged water. When the conductivity of the filtrate was 30 μS/cm or less, the cakey particles were added into ion-exchanged water having an amount that was 10 times greater than the mass of the particles and stirred to sufficiently disperse the particles in the ion-exchanged water. The pH of the dispersion was adjusted to 1.5 by using a 0.3N acetic acid aqueous solution and the dispersion was maintained for 30 minutes. Afterwards, the dispersion was filtered and subjected to washing with ion-exchanged water again, and, when the conductivity of the filtrate was 10 μS/cm or less, the washing process was stopped and solid-liquid separation was performed thereon. The separated cakey particles were dried in vacuum in an oven at 42° C. for 24 hours. The obtained powder was disintegrated using a sample mill and then dried in an oven at 42° C. for 5 hours to obtain toner particles.

1.0 parts of hydrophobic silica (manufactured by NIPPON AEROSIL, trade name: RY50) and 0.8 parts of titanium oxide (manufactured by TITAN KOGYO KABUSHIKI KAISHA, trade name: STT-30S) based on 100 parts of the toner particles were added to the obtained toner particles, and mixed together and stirred at 8000 rpm by using a sample mill for 120 seconds. Afterwards, the resultant mixture was sieved using a stainless steel mesh having an aperture of 45 μm to obtain a toner #1. Physical properties and evaluation results of the toner are shown in Table 4 below.

Example 2

A toner #2 was prepared in the same manner as in Example 1, except that the amorphous polyester resin (A-2) dispersion was used instead of the amorphous polyester resin (A-1) dispersion, the aggregating process was performed at 45° C. for 2 hours, and the fusing process was performed at 74° C. for 2.5 hours.

Example 3

A toner #3 was prepared in the same manner as in Example 1, except that the amorphous polyester resin (B-2) dispersion was used instead of the amorphous polyester resin (B-1) dispersion, the aggregating process was performed at 52° C. for 2 hours and 50 minutes, and the fusing process was performed at 83° C. for 3 hours.

Example 4

A toner #4 was prepared in the same manner as in Example 1, except that the amorphous polyester resin (A-3) dispersion was used instead of the amorphous polyester resin (A-1) dispersion, the amorphous polyester resin (B-2) dispersion was used instead of the amorphous polyester resin (B-1) dispersion, the aggregating process was performed at 52° C. for 2 hours and 50 minutes, pH after the addition of the addition particle dispersion was adjusted to 7.9, and the fusing process was performed at 83° C. for 5 hours.

Example 5

A toner #5 was prepared in the same manner as in Example 1, except that the amorphous polyester resin (B-2) dispersion was used instead of the amorphous polyester resin (B-1) dispersion, the crystalline polyester resin (C-2) dispersion was used instead of the crystalline polyester resin (C-1) dispersion, the aggregating process was performed at 50.5° C. for 2 hours, pH after the addition of the addition particle dispersion was adjusted to 8.1, and the fusing process was performed at 83° C. for 4 hours.

Comparative Example 1

A toner #6 was prepared in the same manner as in Example 1, except that the amorphous polyester resin (A-3) dispersion was used instead of the amorphous polyester resin (A-1) dispersion, the aggregating process was performed at 47° C. for 3 hours and 50 minutes, and the fusing process was performed at 75° C. for 4 hours.

Comparative Example 2

A toner #7 was prepared in the same manner as in Example 1, except that the amorphous polyester resin (A-4) dispersion was used instead of the amorphous polyester resin (A-1) dispersion, the aggregating process was performed at 48° C. for 4 hours, and the fusing process was performed at 78° C. for 3 hours.

Physical properties of the toners prepared according to Examples 1 to 5 and Comparative Examples 1 and 2 were evaluated using the evaluation methods described below, and the evaluation results are shown in Table 4 below.

(Evaluating Apparatus)

In a room under conditions of a temperature of 25° C. and a relative humidity of 55RH %, each of the toners of Examples 1 to 5 and Comparative Examples 1 and 2 was set in the toner cartridges of a commercial printer (SAMSUNG ELECTRONICS, product name: CLP-660ND), the developing toner amount of a monocolor solid image was adjusted to be 0.70 mg/cm2, and then a unfixed image (2.5 cm×4 cm) was printed on paper. In this regard, the same cyan toner was set in each cartridge for Cyan, Magenta, and Yellow. Thus, the printed image is not a colored image, but a stacked image with two layers of the same cyan toner.

(Fixability Evaluation)

The unfixed image formed on XEROX EXCLUSIVE 90 g/m2 A4 paper under the conditions above was fixed by varying a fixing temperature from 100° C. to 190° C. by using a jig transformed from a fixing unit of the printer (CLP-660ND). In this regard, a process speed was about 190 mm/sec. A 3M tape (SCOTCH MENDING TAPE 810-3-15) was adhered to a surface of the fixed image, and the tape was removed after reciprocating five times using a 500 g weight and applying a constant force of 100 kPa to the tape. Image densities of before and after tape peeling were measured using a Macbeth-type reflective densitometer. A minimum temperature at which a change rate in image density at each temperature is 90% or more was defined as a minimum fixing temperature. The fixability of the toner was evaluated under the following conditions.

○: minimum fixing temperature of less than 130° C.

Δ: minimum fixing temperature from equal to or greater than 130° C. and less than 150° C.

x: minimum fixing temperature of 150° C. or more (Anti-Hot-Offset Property)

An anti-hot-offset property of the toner was evaluated in accordance with the measurement of the minimum fixing temperature, but the fixing process was performed using the fixing jig after forming an unfixed image using the printer (CLP-660ND) and transferring the toner image. Subsequently, it was observed with the naked eye whether toner contamination occurred on the transferring medium when white paper as a transferring medium was transferred to the fixing unit under the same conditions, and this operation was repeatedly performed by gradually increasing a preset temperature of the fixing unit. A minimum preset temperature at which contamination by toner occurred was defined as a hot-offset generating temperature.

○: hot-offset generating temperature of 190° C. or more

Δ: hot-offset generating temperature from equal to or greater than 180° C. and less than 190° C.

x: hot-offset generating temperature of less than 180° C.

(Gloss Evaluation)

The unfixed image formed under the conditions above was fixed in the fixing unit at 160° C. to obtain a fixed image. A degree of gloss of a central portion of the fixed image was measured at a measurement angle of 60° by using a glossmeter (manufacturer: BYK GARDNER, model: micro-TRI-gloss).

○: 8 to 10

Δ: 5 to 8 x: 3 to 5

(Heat Storage Ability Evaluation)

The toner was maintained at 50° C. and a relative humidity of 80% for 15 hours, and heat storage ability of the toner was evaluated as follows by using a powder tester (Model Name: PT-S, HOSOKAWA MICRON POWDER SYSTEMS) and three kinds of meshes respectively having an aperture of 53 μm, 45 μm, and 38 μm, which were respectively positioned at top, middle, and bottom portions. That is, 2.0 g of the uniformly mixed toner was placed on the mesh positioned at the top and vibrated at a vibration amplitude of 1.0 mm for 40 seconds, the amount of toner remaining on each mesh was measured, and the heat storage ability of the toner was calculated from the toner amount by the following equation:

$$\text{Degree of Aggregation (\%)}=[(1.0\times a+0.6\times b+0.2\times c)/2.0]\times 100.$$

wherein a: a mass of toner remaining on the mesh having an aperture of 53 μm, b: a mass of toner remaining on the mesh having an aperture of 45 μm, and c: a mass of toner remaining on the mesh having an aperture of 38 μm.

○: less than 10%

Δ: equal to or greater than 10% and equal to or less than 20% x: greater than 20%

(Charging Ability Evaluation)

The toner was maintained under high temperature and high humidity (HH: 30° C., 80%) condition and under low temperature and low humidity (LL: 10° C., 10%) condition each for 8 hours. Then, 18.6 g of a magnetic substance carrier (manufacturer: KDK, Model: SY248) and 1.4 g of the toner were added to a 50 ml glass container and stirred using a turbula mixer, and a charging amount of the toner was measured using an electric field separation method. A ratio (HH/LL) of a charging amount under the HH condition to a charging amount under the LL condition was determined as the charging ability of the toner.

○: 0.55 or more

Δ: equal to or greater than 0.45 and less than 0.55 x: less than 0.45

TABLE 4

| | Example 1 | Example 2 | Example 3 | Example 4 | Example 5 | Comparative Example 1 | Comparative Example 2 |
|---|---|---|---|---|---|---|---|
| Toner # | #1 | #2 | #3 | #4 | #5 | #6 | #7 |
| Weight average molecular weight of toner (g/mol) | 47,500 | 42,700 | 65,000 | 39,800 | 51,000 | 28,000 | 82,000 |

TABLE 4-continued

| | Example 1 | Example 2 | Example 3 | Example 4 | Example 5 | Comparative Example 1 | Comparative Example 2 |
|---|---|---|---|---|---|---|---|
| Main peak molecular weight (g/mol) | 11,200 | 13,000 | 12,000 | 9,000 | 11,000 | 8,000 | 22,000 |
| Presence of peak in a molecular weight range of 100 to 1,000 g/mol | ○ | ○ | ○ | ○ | ○ | ○ | ○ |
| Presence of peak in a molecular weight range of 1,000 to 5,000 g/mol | ○ | ○ | ○ | ○ | ○ | ○ | ○ |
| Presence of peak in a molecular weight range of 5,000 to 20,000 g/mol | ○ | ○ | ○ | ○ | ○ | ○ | x |
| Area ratio of a portion corresponding to molecular weight of 1,000 g/mol or less (%) | 6.8 | 7.1 | 6.2 | 6.0 | 6.4 | 11.2 | 2.9 |
| [Fe2]/[Fe1] ratio | 0.42 | 0.40 | 0.36 | 0.38 | 0.41 | 0.43 | 0.36 |
| Toner Tg (° C.) | 52.8 | 52.7 | 53.7 | 52.0 | 51.1 | 50.3 | 54.3 |
| Toner size D50v (μm) | 6.6 | 6.7 | 6.5 | 6.3 | 6.4 | 6.6 | 6.3 |
| Fixability | ○ | ○ | ○ | ○ | ○ | Δ | Δ |
| Gloss | ○ | ○ | ○ | ○ | ○ | x | ○ |
| Anti-hot-offset property | ○ | ○ | ○ | ○ | ○ | Δ | ○ |
| Heat storage ability | ○ | ○ | ○ | ○ | ○ | Δ | ○ |
| Charging ability | ○ | ○ | ○ | ○ | ○ | ○ | ○ |

Referring to Table 4, by appropriately mixing the crystalline polyester resin with the amorphous polyester resin (A) having a high molecular weight and a high acid value, the amorphous polyester resin (B) having a low molecular weight and a low acid value, and an ester-based wax, the toners of Examples 1 to 5 in which a weight average molecular weight of each toner measured by using a GPC method on a THF soluble fraction is in a range of about 30,000 to about 80,000 g/mol, and a molecular weight distribution curve of each toner obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol, and a peak area corresponding to a molecular weight of 1,000 g/mol or less accounts for about 3% to about 10% of a total area of the molecular weight distribution curve obtained by using a GPC method on a THF soluble fraction have more than certain levels of low-temperature fixability, an anti-hot-offset property, charging ability, gloss, and heat storage ability, as compared to those of the toners of Comparative Examples 1 and 2.

As described above, according to the one or more embodiments of the present invention, a toner may have more than certain levels of low-temperature fixability, a heat storage ability, and high gloss of an image. Therefore, the toner has a long lifetime, and thus, may provide a high-quality image for a long period of time in a stable and energy-saving manner.

Figure 2:
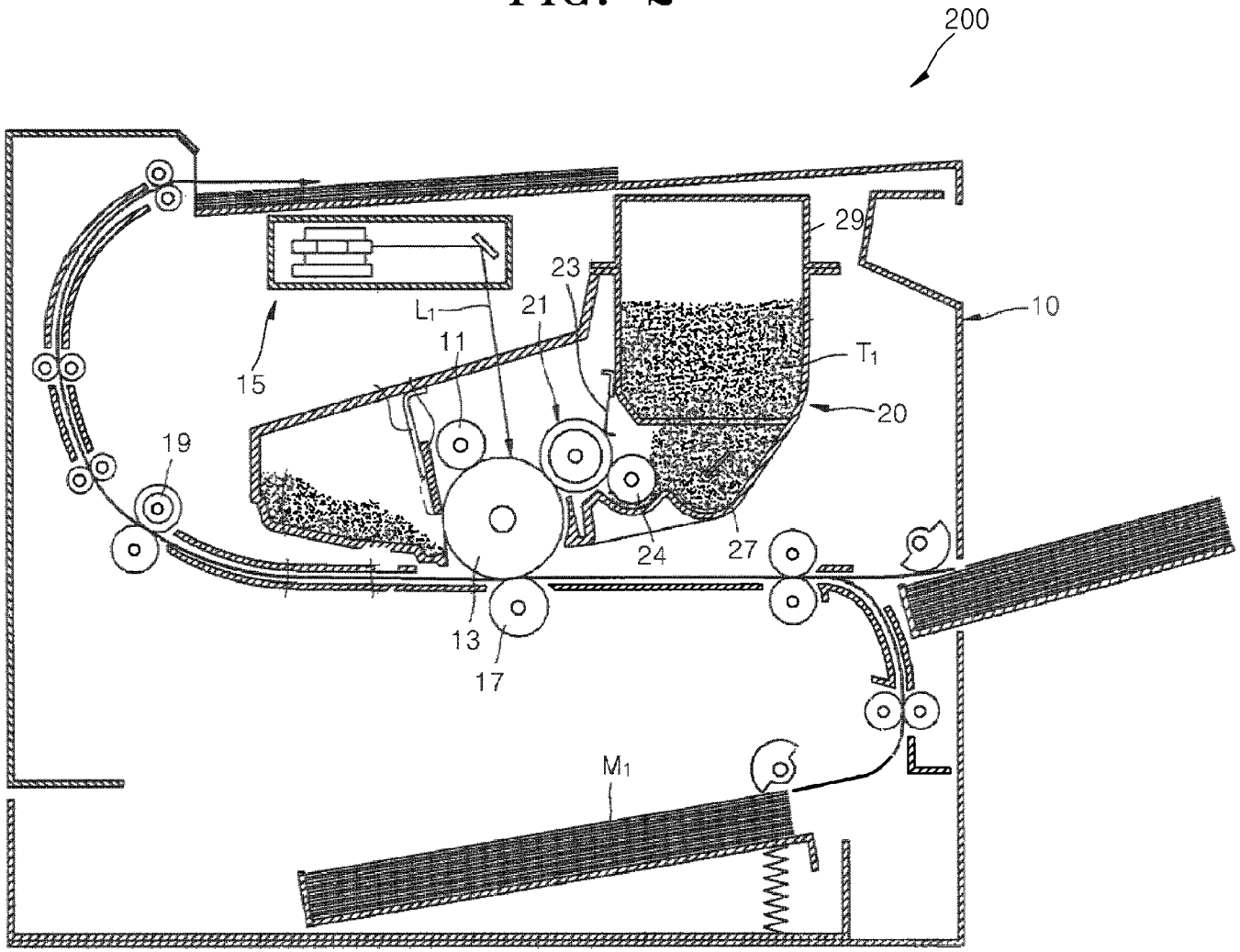
FIG. 2 illustrates an image forming apparatus having a toner cartridge/device to supply toner to develop an electrostatic charge image in accordance with embodiments of the present general inventive concept.

As illustrated in FIG. 2, an electrophotographic charge image forming apparatus 200 includes a cabinet 10, a charging unit 11 provided inside the cabinet 10, a photosensitive medium (electrostatic charge forming member) 13, a light scanning unit 15, a developing (toner) cartridge 20, a transferring roller 17 and a fusing (fixing) roller 19.

The photosensitive medium 13 is disposed inside the developing cartridge/device 20. The photosensitive medium 13 is charged to have a predetermined electric potential by the charging unit 11, and responds to a light $L_1$ scanned from the light scanning unit 15 to form an electrostatic latent image corresponding to an image to be printed.

The developing (toner) cartridge/device 20 accommodates a developer/toner $T_1$ in a developer accommodating part 29, and supplies the toner $T_1$ to the photosensitive medium 13 through an agitator 27, a supplying roller 24 and a developing device (roller) 21 to form the image. Here, a regulating blade 23 is applied to an outer surface of the developing roller 21 to regulate the amount of the supplied toner $T_1$. The toner $T_1$ transported through the developing roller 21 passes between the regulating blade 23 and the developing roller 21 to form a toner layer having a predetermined thickness on the developing roller 21. The image formed on the photosensitive medium 13 is transferred to a print medium $M_1$, transported between the photosensitive medium 13 and the transferring roller 17, and is fused to the print medium $M_1$ by the fusing (fixing) roller 19.

Exemplary embodiments of the present general inventive concept may provide a process cartridge 20 that includes an electrostatic charge image bearing member 13 configured to bear an electrostatic charge image and a developing device 21 configured to develop the electrostatic charge image with a toner $T_1$ that develops an electrostatic charge image. The toner $T_1$ includes at least a binder resin, a colorant, and a releasing agent. A weight average molecular weight of the toner $T_1$ measured by using a gel permeation chromatography (GPC) method on a tetrahydrofuran (THF) soluble fraction is in a range of about 30,000 to about 80,000 g/mol. A molecular weight distribution curve of the toner $T_1$ obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol to form a toner image.

Exemplary embodiments of the present general inventive concept may provide a toner device/cartridge 20 that includes a container (developer accommodating part) 29 to supply the toner $T_1$. The toner $T_1$ includes at least a binder resin, a colorant, and a releasing agent. A weight average molecular weight of the toner $T_1$ measured by using a gel permeation chromatography (GPC) method on a tetrahydrofuran (THF) soluble fraction is in a range of about 30,000 to about 80,000 g/mol. A molecular weight distribution curve of the toner $T_1$ obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol to form a toner image.

Figure 3:
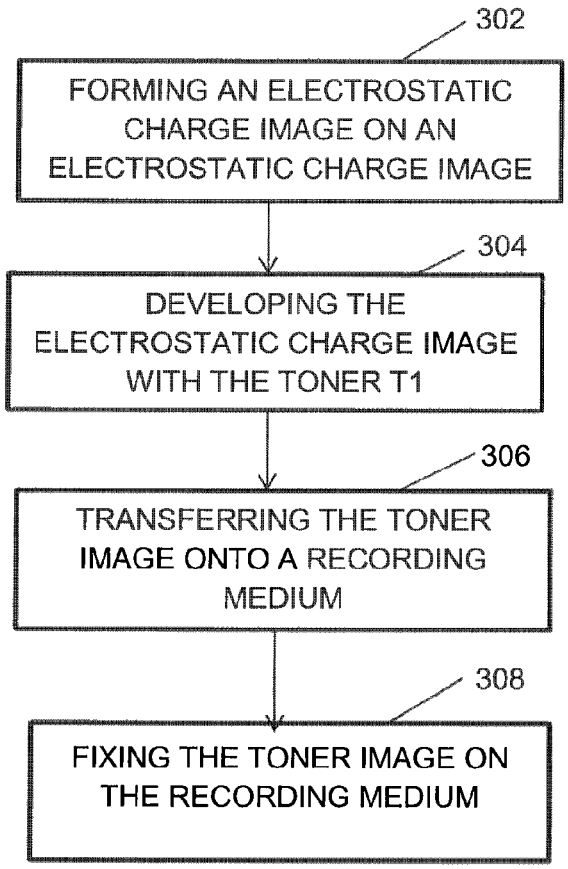
FIG. 3 illustrates a flow chart of a method of forming an image in an image forming apparatus in accordance with an embodiment of the present general inventive concept.

Exemplary embodiments of the present general inventive concept may provide an image forming apparatus 200 that includes an electrostatic charge image forming member 13 configured to bear an electrostatic charge image, an electrostatic charge image forming device 11 configured to form an electrostatic charge image on the electrostatic charge image bearing member 13, a developing device 21 configured to develop the electrostatic charge image with a toner $T_1$ that develops an electrostatic charge image, to form a toner image, a transfer device/roller 17 configured to transfer the toner image onto a recording medium, and a fixing device/roller 19 configured to fix the toner image on the recording medium $M_1$. The toner $T_1$ includes at least a binder resin, a colorant, and a releasing agent, wherein a weight average molecular weight of the toner measured by using a gel permeation chromatography (GPC) method on a tetrahydrofuran (THF) soluble fraction is in a range of about 30,000 to about 80,000 g/mol. A molecular weight distribution curve of the toner $T_1$ obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol As illustrated in FIG. 3, exemplary embodiments of the present general inventive concept may also provide an image forming method that includes the operations of forming an electrostatic charge image on an electrostatic charge image bearing member 302, developing the electrostatic charge image with the toner $T_1$ including at least a binder resin, a colorant, and a releasing agent, wherein a weight average molecular weight of the toner $T_1$ measured by using a gel permeation chromatography (GPC) method on a tetrahydrofuran (THF) soluble fraction is in a range of about 30,000 to about 80,000 g/mol, and a molecular weight distribution curve of the toner $T_1$ obtained by using the GPC method on the THF soluble fraction has at least one peak in a molecular weight range of 100 to 1,000 g/mol, a peak in a molecular weight range of 1,000 to 5,000 g/mol, and a main peak in a molecular weight range of 5,000 to 20,000 g/mol to form a toner image 304, transferring the toner image onto a recording medium 306, and fixing the toner image on the recording medium 308.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner to develop an electrostatic charge image, the toner comprising at least a binder resin, a colorant, and a releasing agent, wherein the binder resin comprises about 80 to about 98 mass % of an amorphous polyester resin and about 2 to about 20 mass % of a crystalline polyester resin, wherein the toner has a core-shell structure comprising a core layer and a shell layer, wherein the core layer comprises an amorphous polyester resin and a crystalline polyester resin as a binder resin and the shell layer comprises only an amorphous polyester resin as a binder resin, wherein a weight average molecular weight of the toner measured by using a gel permeation chromatography (GPC) method on a tetrahydrofuran (THF) soluble fraction is in a range of about 35,000 to about 60,000 g/mol, wherein a molecular weight distribution curve of the toner obtained by using the GPC method on the THF soluble fraction has at least one peak in a molecular weight range of greater than or equal to 100 and less than 1,000 g/mol, a peak in a molecular weight range of 1,000 to 5,000 g/mol, and a main peak in a molecular weight range of 5,000 to 20,000 g/mol, and wherein in the molecular weight distribution curve of the toner obtained by using the GPC method on the THF soluble fraction, a peak area corresponding to a molecular weight of 1,000 g/mol or less provides for about 4% to about 8% of a total area of the molecular weight distribution curve.

2. The toner of claim 1, wherein the releasing agent is an ester-based wax.

3. The toner of claim 1, wherein the toner is prepared using an emulsion aggregation method using polysilicate iron as an aggregating agent.

4. The toner of claim 1, wherein, when a total iron intensity included in the toner which is determined by X-ray fluorescence (XRF) measurement and an intensity of an iron present on the surface of the toner which is determined by X-ray photoelectron spectroscopy (XPS) are denoted as [Fe1] and [Fe2], respectively, an [Fe2]/[Fe1] ratio of the toner satisfies the following condition: $0.05 \leq [Fe2]/[Fe1] \leq 0.5$.

* * * * *